US011846468B2

(12) United States Patent
Kunz et al.

(10) Patent No.: US 11,846,468 B2
(45) Date of Patent: Dec. 19, 2023

(54) METHOD AND UNIT FOR LOW-TEMPERATURE AIR SEPARATION

(71) Applicant: Linde GmbH, Pullach (DE)

(72) Inventors: Christian Kunz, Munich (DE); Stefan Lochner, Grafing (DE); Wolfgang Haag, Stadtbergen (DE); Lars Kirchner, Dresden (DE); Tobias Lautenschlager, Gröbenzell (DE); Dimitri Golubev, Geretsried (DE)

(73) Assignee: Linde GmbH, Pullach (DE)

( * ) Notice: Subject to any disclaimer, the term of this patent is extended or adjusted under 35 U.S.C. 154(b) by 419 days.

(21) Appl. No.: 17/287,854

(22) PCT Filed: Oct. 22, 2019

(86) PCT No.: PCT/EP2019/025356
§ 371 (c)(1),
(2) Date: Apr. 22, 2021

(87) PCT Pub. No.: WO2020/083528
PCT Pub. Date: Apr. 30, 2020

(65) Prior Publication Data

US 2021/0381761 A1 Dec. 9, 2021

(30) Foreign Application Priority Data

Oct. 23, 2018 (EP) ..... 18020542
Oct. 23, 2018 (EP) ..... 18020543

(51) Int. Cl.
*F25J 3/04* (2006.01)

(52) U.S. Cl.
CPC ..... *F25J 3/04054* (2013.01); *F25J 3/0409* (2013.01); *F25J 3/0423* (2013.01);
(Continued)

(58) Field of Classification Search
CPC .. F25J 3/04212; F25J 3/04454; F25J 3/04715; F25J 2200/08; F25J 3/04054;
(Continued)

(56) References Cited

U.S. PATENT DOCUMENTS 5,137,559 A 8/1992 Agrawal
5,255,524 A 10/1993 Agrawal et al.
(Continued)

FOREIGN PATENT DOCUMENTS

DE 10152356 A1 12/2002
DE 102016015446 A1 6/2018
FR 1372220 A 9/1964

OTHER PUBLICATIONS

H.-W. Häring (editor), Industrial Gases Processing, Wiley-VCH, 2006, in particular section 2.2.5, "Cryogenic Rectification."

*Primary Examiner* — Lionel Nouketcha
(74) *Attorney, Agent, or Firm* — MILLEN WHITE ZELANO & BRANIGAN, PC; Brion P. Heaney

(57) ABSTRACT

The invention relates to a method for a low-temperature air separation in which an air separation unit is used comprising a first rectification column and a second rectification column. The first rectification column is operated at a first pressure level, and the second rectification column is operated at a second pressure level below the first pressure level. Fluid which is oxygen-enriched compared to atmospheric air is drawn from the first rectification column in the form of one or more first material flows. At least one fraction of the fluid which has been drawn from the first rectification column in the form of the one or more first material flows is heated in a heat exchanger; a fraction of the fluid which has been heated in the heat exchanger is compressed using a compressor and is returned to the first rectification column.

13 Claims, 29 Drawing Sheets

(52) U.S. Cl.
CPC ..... *F25J 3/0429* (2013.01); *F25J 3/04084* (2013.01); *F25J 3/04096* (2013.01); *F25J 3/04212* (2013.01); *F25J 3/04321* (2013.01); *F25J 3/04454* (2013.01); *F25J 3/04715* (2013.01); *F25J 3/04721* (2013.01); *F25J 2200/08* (2013.01); *F25J 2210/06* (2013.01); *F25J 2210/42* (2013.01); *F25J 2215/52* (2013.01); *F25J 2230/50* (2013.01); *F25J 2235/50* (2013.01)

(58) Field of Classification Search
CPC .... F25J 3/04084; F25J 2210/42; F25J 3/0409; F25J 3/04096
See application file for complete search history.

(56) References Cited

U.S. PATENT DOCUMENTS

| | | | |
|---|---|---|---|
| 2009/0120128 | A1 | 5/2009 | Lochner |
| 2010/0037656 | A1 | 2/2010 | Prosser et al. |
| 2015/0316317 | A1 | 11/2015 | Goloubev |

METHOD AND UNIT FOR LOW-TEMPERATURE AIR SEPARATION

The invention relates to a method for a low-temperature air separation and to a corresponding unit in accordance with the preambles of the independent claims.

PRIOR ART

The production of air products in the liquid or gaseous state by low temperature separation of air in air separating installations is known and is described, for example, in H.-W. Haring (editor), Industrial Gases Processing, Wiley-VCH, 2006, in particular section 2.2.5, "Cryogenic Rectification."

Air separation units have rectification column systems which can conventionally be designed, for example, as two-column systems, in particular as conventional Linde double-column systems, but also as three-column or multi-column systems. In addition to the rectification columns for extracting nitrogen and/or oxygen in the liquid and/or gaseous state, i.e., the rectification columns for nitrogen-oxygen separation, rectification columns for extracting additional air components, in particular the noble gases krypton, xenon, and/or argon, may be provided. Frequently, the terms "rectification" and "distillation" as well as "pillar" and "column" or terms composed thereof are used synonymously.

The rectification columns of the mentioned rectification column systems are operated at different pressure levels. Known double-column systems have a so-called high-pressure column (also referred to as a pressure column, medium-pressure column, or lower column) and a so-called low-pressure column (also referred to as an upper column). The high-pressure column is typically operated at a pressure level of 4 to 7 bar, in particular approximately 5.3 bar. The low-pressure column is operated at a pressure level of typically 1 to 2 bar, in particular approximately 1.4 bar. In certain cases, higher pressure levels may also be used in both rectification columns. The pressures indicated here and below are absolute pressures at the head of the columns indicated in each case.

So-called SPECTRA methods are known from the prior art for providing compressed nitrogen as the main product. These methods are explained in detail below. The present invention has the object, in embodiments, of improving such SPECTRA methods, primarily with regard to energy consumption and material yield. A main focus of the object offered in the present invention is, in particular, also to specify a method and an air separation unit by means of which, in addition to larger quantities of high-purity, gaseous nitrogen at a distinctly superatmospheric pressure level, an additional nitrogen product and/or argon can also advantageously be provided.

DISCLOSURE OF THE INVENTION

Against this background, the present invention proposes a method for low-temperature air separation and a corresponding unit with the features of the independent claims. Preferred embodiments are in each case the subject matter of the dependent claims and of the following description.

Prior to explaining the features and advantages of the present invention, some of the principles of the present invention are explained in greater detail and terms used below are defined.

The devices used in an air separating installation are described in the cited technical literature, for example in Haring (see above) in section 2.2.5.6, "Apparatus." Unless the following definitions differ, reference is therefore explicitly made to the cited technical literature for the purpose of terminology used in the context of the present application.

Liquids and gases may, in the terminology used herein, be rich or poor in one or more components, wherein "rich" can refer to a content of at least 75%, 90%, 95%, 99%, 99.5%, 99.9%, or 99.99%, and "poor" can refer to a content of at most 25%, 10%, 5%, 1%, 0.1%, or 0.01% on a mole, weight, or volume basis. The term "predominant" may correspond to the definition of "rich." Liquids and gases may also be enriched in or depleted of one or more components, wherein these terms refer to a content in a starting liquid or a starting gas from which the liquid or gas has been extracted. The liquid or the gas is "enriched" if it contains at least 1.1 times, 1.5 times, 2 times, 5 times, 10 times, 100 times, or 1,000 times the content, and "depleted" if it contains at most 0.9 times, 0.5 times, 0.1 times, 0.01 times, or 0.001 times the content of a corresponding component based on the starting liquid or the starting gas. If, by way of example, reference is made here to "oxygen," "nitrogen," or "argon," this is also understood to mean a liquid or a gas which is rich in oxygen or nitrogen but need not necessarily consist exclusively of it.

The present application uses the terms "pressure level" and "temperature level" to characterize pressures and temperatures, which means that corresponding pressures and temperatures in a corresponding installation do not have to be used in the form of exact pressure or temperature values in order to realize the inventive concept. However, such pressures and temperatures typically fall within certain ranges that are, for example, ±1%, 5%, 10%, or 20% around an average. In this case, corresponding pressure levels and temperature levels can be in disjointed ranges or in ranges which overlap one another. In particular, pressure levels, for example, include unavoidable or expected pressure losses. The same applies to temperature levels. The pressure levels indicated here in bar are absolute pressures.

The term "expansion machines" is understood here to mean typically known turboexpanders. These expansion machines may in particular also be coupled to compressors. These compressors may, in particular, be turbocompressors. A corresponding combination of a turboexpander and turbocompressor is typically also referred to as a "turbine booster." In a turbine booster, the turboexpander and the turbocompressor are mechanically coupled, the coupling being able to take place at the same rotational speed (for example via a common shaft) or at different rotational speeds (for example via a suitable geared transmission). Generally, the term "compressor" is used herein. Here, a "cold compressor" denotes a compressor to which a fluid flow at a temperature level significantly below 0° C., in particular below −50, −75, or −100° C. and down to −150 or −200° C., is supplied. A corresponding fluid flow is cooled to a corresponding temperature level, in particular by means of a main heat exchanger (see directly below).

A "main air compressor" is distinguished in that the entire air supplied to the air separation unit and separated there is compressed thereby. In contrast, in one or more optionally provided additional compressors, for example booster compressors, only a fraction of this air which has already been compressed previously in the main air compressor is further compressed. Correspondingly, the "main heat exchanger" of an air separation unit represents the heat exchanger in which at least the predominant fraction of the air supplied to the air separation unit and separated there is cooled. This takes place at least in part in a counterflow to material flows which are discharged from the air separation unit. Material flows or "products" which are "discharged" from an air separation unit are, in the terminology used herein, fluids which no longer participate in unit-internal circuits but are permanently removed therefrom.

A "heat exchanger" for use in the context of the present invention may be formed in a customary manner. It is used for the indirect transfer of heat between at least two fluid flows conducted, for example, in counterflow to one another, e.g., a warm compressed-air flow and one or more cold fluid flows or a cryogenic liquid air product and one or more warm or warmer, but optionally also still cryogenic, fluid flows. A heat exchanger can be formed from one or more heat exchanger sections connected in parallel and/or serially, e.g., from one or more plate heat exchanger blocks. This is, for example, a plate heat exchanger (plate fin heat exchanger). Such a heat exchanger has "passages" which are designed as separate fluid channels with heat exchange surfaces and are connected in parallel and separated by other passages to form "passage groups." A heat exchanger is characterized in that heat is exchanged therein at some time between two mobile media, namely at least one fluid flow to be cooled and at least one fluid flow to be heated.

A "condenser evaporator" refers to a heat exchanger in which a first, condensing fluid flow enters into indirect heat exchange with a second, evaporating fluid flow. Each condenser evaporator has a liquefaction chamber and an evaporation chamber. The liquefaction and evaporation chambers have liquefaction and evaporation passages, respectively. The condensation (liquefaction) of the first fluid flow is carried out in the liquefaction chamber, and the evaporation of the second fluid flow is carried out in the evaporation chamber. The evaporation and liquefaction chambers are formed by groups of passages which are in a heat exchange relationship with one another.

The relative spatial terms, "upper," "lower," "over," "under," "above," "below," "adjacent to," "next to," "vertical," "horizontal," etc. here refer to the spatial orientation of the rectification columns of an air separation unit in normal operation. An arrangement of two rectification columns or other components "one above the other" is understood here to mean that the upper end of the lower of the two apparatus parts is located at a lower or the same geodetic height as the lower end of the upper of the two apparatus parts, and the projections of the two apparatus parts overlap in a horizontal plane. In particular, the two apparatus parts are arranged exactly one above the other, that is to say the axes of the two apparatus parts run on the same vertical straight line. However, the axes of the two apparatus parts do not have to lie exactly vertically one above the another but may also be offset from one another, in particular if one of the two apparatus parts, e.g., a rectification column or a column part with a smaller diameter, is to have the same distance from the sheet-metal jacket of a cold box as another one with a larger diameter.

The present invention includes low-temperature air separation according to the so-called SPECTRA method, as described, inter alia, in EP 2 789 958 A1 and the additional patent literature cited therein. In the simplest embodiment, this is a single-column method. Such methods allow a high nitrogen yield. A return flow to a single rectification column in the simplest case is provided here by condensing head gas of this rectification column, more precisely a portion of this head gas, in a heat exchanger. In the heat exchanger, fluid drawn from the same rectification column is used for cooling. Additional head gas can be provided as a nitrogen-rich product of the method or the unit.

By means of a cold compressor, a portion of the fluid used to condense the portion of the head gas treated in this way is compressed and returned to the same rectification column. By means of SPECTRA methods, very favorable air factors can be achieved, i.e., a large quantity of product per quantity of air used. A corresponding method is first explained in more detail below. The term "SPECTRA method" is to be understood to mean the explained single-column method for nitrogen extraction or a modified single-column method in which, as also explained below, an additional rectification column is used for oxygen extraction.

As with other methods for low-temperature air separation, compressed and pre-purified air is also cooled in the SPECTRA method to a temperature suitable for rectification. It can thereby be partially liquefied. The air is subsequently fed into the rectification column just mentioned and is rectified there under the typical pressure of a high-pressure column, as explained at the outset, to obtain the already mentioned head gas which is nitrogen-enriched compared to atmospheric air, and a liquid sump liquid which is oxygen-enriched compared to atmospheric air.

In a SPECTRA method, the mentioned rectification column, in which a gaseous head product which is nitrogen-enriched compared to atmospheric air is formed on the one hand and a liquid sump product which is oxygen-enriched compared to atmospheric air is formed on the other hand, is thus used in an air separation unit. The terms "head product" and "head gas" on the one hand and "sump product" and "sump liquid" on the other hand are always used synonymously here.

This rectification column, a portion of whose head gas is liquefied or partially liquefied in the manner explained using expanded fluid from the same rectification column and at least one portion thereof is then returned to the same rectification column, is referred to herein as the "first" rectification column. As mentioned, this can also be the only rectification column in known SPECTRA methods. However, this is not the case in the context of the present invention.

The fluid which is used to condense the portion of the head gas of the first rectification column treated in this way and which may, in particular, be a cryogenic liquid which is oxygen-enriched compared to atmospheric air, is drawn from the first rectification column in the form of one or more material flows. At least one portion thereof is heated in the heat exchanger, which is used to condense the portion of the head gas of the first rectification column treated in this way.

This/these material flow(s) is/are referred to hereinafter as "first" material flow(s). The fluid can be conducted through the heat exchanger in the form of only a first material flow or in the form of two or more separate first material flows. For example, a material flow can first be drawn from the rectification column and subsequently divided, or two separate first material flows, in particular with different oxygen contents, can already be drawn separately from one another from the rectification column.

In the SPECTRA method, as likewise already mentioned and expressed here again in other words, a first portion of the fluid drawn from the first rectification column in the form of the one or more first material flows and heated in the heat exchanger is compressed in one or more compressors and, after this compression, is fed back into the first rectification column again.

A second portion of the fluid drawn from the first rectification column in the form of the one or more first material flows and heated in the heat exchanger can be expanded in the SPECTRA method using one or more expansion machines, and in particular discharged as a so-called residual gas mixture from the air separation unit.

The first and second portions of the fluid drawn from the rectification column in the form of the one or more first material flows, i.e., the compressed and the expanded portion, may in turn be two first material flows, as explained above, which have already been separately discharged from the first rectification column. However, they may also be fractions of only one first material flow drawn from the first rectification column. The first and second portions may also have been conducted through the heat exchanger while still together, and may only thereafter be divided into the first and second portions.

For the compression of the mentioned first portion of the fluid, which is drawn from the first rectification column in the form of the one or more first material flows and heated in the heat exchanger, one or more compressors which are coupled to one or more expansion machines may, in particular, be used. The expansion of the mentioned second portion of the fluid, which is drawn from the first rectification column in the form of the one or more first material flows and is heated in the heat exchanger, may in particular be carried out in the expansion machine(s). However, it goes without saying that only portions of the first or second fractions in the correspondingly coupled units can also each be compressed or expanded. An expansion machine which is not coupled to a corresponding compressor can, if present, be braked in particular mechanically and/or by means of a generator. Braking is also additionally possible in the case of an expansion machine which is coupled to a compressor.

For example, a compressor which is coupled to one of two expansion machines arranged in parallel can be used here. If only one expansion machine is used, the compressor may be coupled thereto. The formulation used below only for reasons of clarity, according to which "a" compressor is coupled to "an" expansion machine, does not preclude the use of a plurality of compressors and/or expansion machines in any mutual coupling. However, the compressor(s) described does/do not, in particular not exclusively, have to be driven by means of the one or more mentioned expansion machines.

Conversely, the compressor(s) also does/do not have to take up the entire work that is released during the expansion. As also illustrated below with reference to an example, driving can, for example, also be supportive or exclusively using an electric motor, or a brake can be interposed between the expansion machine(s) and the compressor(s).

The compressor(s) is/are one or more cold compressors since it/they is/are supplied with the first fraction of the fluid, which is drawn from the rectification column in the form of the one or more first material flows and heated in the heat exchanger, at a correspondingly low temperature level despite this heating and an optionally subsequent further heating.

Instead of the explained expansion of the second portion of the fluid which is drawn from the rectification column in the form of the one or more first material flows and heated in the heat exchanger, and its described discharge from the air separation unit, a corresponding expansion can also be dispensed with and/or this second portion can be fed, with or without expansion, into one or more additional rectification columns as explained below.

In a more specific exemplary embodiment of a SPECTRA method, two first material flows in the form of a liquid material flow having a first oxygen content and a liquid material flow having a second, higher oxygen content can be withdrawn from the first rectification column. The first material flow having the first (lower) oxygen content can be withdrawn from the first rectification column from an intermediate bottom or from a liquid-retaining device. The second material flow having the second (higher) oxygen content may in particular be formed using at least one portion of the liquid sump product of the first rectification column.

The first material flow having the first (lower) oxygen content can in particular form the first portion of the fluid explained above, which is drawn from the first rectification column in the form of the one or more first material flows and heated in the heat exchanger, which is used to condense the portion of the head gas of the first rectification column treated in this way. The first material flow having the first (lower) oxygen content may thus form that first portion which, after use, is compressed in the one or more compressors and which is then fed back into the first rectification column.

In contrast, the first material flow having the second (higher) oxygen content can in particular form the second portion of the fluid explained above, which is drawn from the first rectification column in the form of the one or more first material flows and heated in the heat exchanger which is used to condense the portion of the head gas of the first rectification column treated in this way. The first material flow having the second (higher) oxygen content may thus form that second portion which, after use, is compressed in the one or more compressors and which is then fed back into the first rectification column.

In the mentioned SPECTRA methods, it is furthermore possible to use so-called oxygen columns, which are operated at the pressure level of typical low-pressure columns explained at the outset, in order to extract pure or high-purity oxygen. A corresponding oxygen column is also referred to below as a "second" rectification column.

Additional fluid is fed into such a second rectification column from the first rectification column. This additional fluid contains oxygen, argon and nitrogen, and is drawn in liquid form from the first rectification column in the form of (at least) one additional material flow (hereinafter referred to as a "second" material flow). In the exemplary embodiment just explained with two "first" material flows having different oxygen contents, the second material flow is in particular drawn above the first material flow having the first (lower) oxygen content.

While the SPECTRA method was originally intended for providing gaseous nitrogen at the pressure level of the first rectification column, the use of an oxygen column of the type explained in a corresponding method enables the additional extraction of pure oxygen.

Advantages of the Invention

The present invention is based on the knowledge that a method of the type explained above can be modified particularly advantageously in that the oxygen column just explained, i.e., a second rectification column used in a modified SPECTRA method, is formed as part of a double column which, in addition to the second rectification column, comprises a third rectification column which is arranged as part of the double column below the second rectification column, and to which additional air is supplied. The present invention thus provides an air feed in a SPECTRA method not only into the first column but also into the third column.

Overall, in the terminology used in the claims, the present invention proposes a method for low-temperature air separation in which an air separation unit having a first rectification column and a second rectification column is used. The first rectification column is operated at a first pressure level, and the second rectification column is operated at a second pressure level below the first pressure level.

Such first and second pressure levels are typical pressure levels as also used in conventional air separation units, in particular SPECTRA units with oxygen extraction. The first pressure level can in particular be 7 to 12 bar; the second pressure level can in particular be 1.2 to 5 bar. The second pressure level can generally also be 1 to 4 bar. These pressures are each absolute pressures at the head of the respective rectification columns. The first rectification column and the second rectification column can in particular be arranged next to one another and are typically not combined with one another in the form of a double column, a "double column" being understood here generally as a separating apparatus which is formed from two rectification columns and is designed as a structural unit in which column jackets of the two rectification columns are connected, in particular welded, without lines, i.e., directly, to one another. However, this direct connection alone does not have to produce any fluidic connection.

The first rectification column used in the context of the present invention and the second rectification column used in the context of the present invention have already been described in detail above with reference to the SPECTRA method. The second rectification column may in particular be an oxygen column.

Atmospheric air, which has been compressed and then cooled, is supplied to the first rectification column. In particular, corresponding air can be supplied to the first rectification column in the form of a plurality of material flows which can be treated differently and optionally conducted through additional apparatuses beforehand. The air fed into the first rectification column can be fed in particular in the form of a liquefied partial flow and a non-liquefied partial flow. Further embodiments of the air feed, which can be used in particular in the context of the present invention, are explained in more detail below. In contrast, no air is typically supplied to the second rectification column; more generally speaking, the second rectification column is typically not supplied any material flows which were previously not drawn from another rectification column or formed from such material flows.

As already explained in more detail above, fluid which is oxygen-enriched compared to atmospheric air is drawn from the first rectification column in the form of one or more first material flows. As previously explained with respect to the more specific exemplary embodiment of a SPECTRA method, these material flows in this case may, in particular, be two first material flows having different oxygen contents. Reference is therefore explicitly made to the detailed explanations above.

At least one fraction of the fluid drawn from the first rectification column in the form of the one or more first material flows is heated in a heat exchanger in the context of the present invention, and again a fraction thereof, i.e., of the fluid heated in the heat exchanger (and previously drawn from the first rectification column in the form of the one or more first material flows) (referred to above as the "first portion") is compressed in the context of the present invention using a compressor and returned to the first rectification column. A plurality of compressors can, in particular, also be used in this connection, as mentioned. The return of the to the first rectification column takes place in particular in the form of a return feed into a sump region of the first rectification column.

The heat exchanger is used for the cooling and condensation or partial condensation of head gas of the first rectification column, at least one portion of which is returned to the first rectification column as a return flow. In this connection, a first fraction of the head gas of the first rectification column is (partially) condensed in the heat exchanger (and at least one portion thereof is in turn returned to the first rectification column as a return flow). A second fraction of the head gas is discharged from the method or the unit as at least one nitrogen-rich air product.

This at least one air product, like the head gas of the first rectification column from which it was formed, has a certain residual oxygen content which may in particular be 0.001 to 10 ppm. For example, corresponding head gas may be provided in a non-liquefied form as a gaseous nitrogen product at the mentioned first pressure level. This nitrogen product constitutes a main product of the proposed method. It can in particular be heated up to ambient temperature in a main heat exchanger of the air separation unit and subsequently provided at the first pressure level. However, a fraction of the head gas can also be provided as a liquid nitrogen product of the method or of the unit, in particular after supercooling against an additional fraction which is subsequently in particular discarded.

As already explained, in addition to the non-liquefied head gas as the main product, oxygen, in particular high-purity oxygen, is also provided as an air product in the context of the present invention. In embodiments, argon may also be provided as the product of the method.

An additional fraction of the fluid heated in the heat exchanger (and previously drawn from the first rectification column in the form of the one or more first material flows) (referred to as the "second portion" above) can, in the context of the present invention, be expanded in the manner explained and discharged, for example, from the air separation unit. For further details, reference is explicitly made to the above explanations in this context. One or more expansion machines used in this case can in particular be coupled to the compressor(s) mentioned above. Reference is also made in this respect to the above explanations.

It should be understood that when a heat exchanger which is used for cooling or (partial) condensation of the first fraction of the head gas of the first rectification column is mentioned herein, this heat exchanger differs from the main heat exchanger of the air separation unit and is in particular designed as a separate structural unit. As mentioned, the main heat exchanger of the air separation unit is in particular distinguished in that it cools all or at least the largest portion of the total air supplied to the air separation unit. In contrast, this is not the case in the heat exchanger in which the first fraction of the head gas of the first rectification column is cooled or (partially) condensed and through which the first material flow(s) are each at least in part conducted.

As mentioned, the method proposed according to the invention is a SPECTRA method with additional oxygen production. In it, additional fluid containing oxygen, nitrogen, and argon is therefore drawn from the first rectification column. This additional fluid is used as a second material flow or to form a second material flow which is transferred to the second rectification column. In the sump of the second rectification column, an oxygen-rich sump liquid is formed, and at least one fraction thereof is discharged in the form of a third material flow from the second rectification column or the air separation unit as a whole. This oxygen-rich liquid in particular has a residual nitrogen content, as explained in more detail below.

The argon content of the additional fluid drawn from the first rectification column and used as the second material flow or to form the second material flow, which is transferred to the second rectification column, is in particular 2 to 4 mole percent; its oxygen content is in particular 10 to 30 mole percent. The argon content of this fluid depends in particular on the extraction height from the first rectification column which is therefore selected in a suitable manner. As mentioned, the extraction height of this fluid and thus of the second material flow is typically above the extraction height(s) of the fluid which is discharged from the first rectification column in the form of the one or more first material flows. The separating bottoms located between corresponding extraction points in the first rectification column in particular also block hydrocarbons. These extraction heights are therefore also advantageously selected with regard to this aspect so that the obtained oxygen product has the required purity with respect to hydrocarbons.

As also explained in detail below and already briefly addressed above, a double-column system whose upper part forms the second rectification column and whose lower part is referred to herein as the "third" rectification column is used in the context of the present invention. In this case, the additional fluid which is drawn from the first rectification column can, for example, also first be fed into this third rectification column. In this case, however, liquid is again withdrawn from the third rectification column immediately below the feed point into the third rectification column and fed into the second rectification column. The second material flow or corresponding fluid is thus virtually fed here "via the detour" via the third rectification column into the second rectification column. However, such a case is also encompassed by the specification that fluid containing oxygen, nitrogen, and argon is drawn from the first rectification column and used "to form" the second material flow. However, the second material flow may also be a material flow transferred directly, i.e., without a detour via an additional rectification column, into the second rectification column, in which case the from the first rectification column in the terminology used herein is used "as" the second material flow.

Any additional fluid exchange between the first and second rectification columns is possible, in particular in order to compensate for the liquid balance. The invention is not limited by these measures.

As already mentioned, a third rectification column is used according to the invention, the second rectification column and the third rectification column being formed as parts of a double column, the third rectification column being arranged below the second rectification column in the explained sense, and the third rectification column being supplied with air. For the term "double column," reference is made to the above explanations.

The third rectification column is operated in particular at a pressure level between the first and the second pressure level, i.e., between the operating pressure levels of the first and the second rectification column. This pressure level is in particular 4 to 7 bar, in particular approximately 5.5 bar absolute pressure. The third rectification column is supplied with air which was previously compressed and cooled and can be expanded, in particular by means of an additional expansion machine, to the pressure level at which the third rectification column is operated. The air which the third rectification column is supplied thus comprises compressed and cooled air which is expanded using an expansion machine.

In the method according to the invention, the second rectification column can be operated with a condenser evaporator which is arranged in a sump region of the second rectification column, and which is heated using fluid drawn from and/or supplied to the third rectification column. In this way, particularly energy-efficient methods can be implemented.

The air which is optionally expanded by means of the expansion machine and with which the third rectification column is supplied can in particular be at least partially liquefied in the condenser evaporator, which is arranged in the sump region of the second rectification column, and returned to the third rectification column as a liquid return flow.

In the condenser evaporator which may be arranged in the sump region of the second rectification column, head gas of the third rectification column may also be at least partially liquefied and returned to the second or third rectification column as a return flow. In other words, a gaseous head product of the third rectification column can thus be used to heat a condenser evaporator of the second rectification column, wherein liquid formed in the process can be used partially as a return flow to the second rectification column and as a return flow to the third rectification column. A corresponding embodiment has the advantage that a further increase of the argon yield and the total energy range can be achieved.

In the context of the present invention, sump liquid can, in particular, be formed in the third rectification column and can be fed into the second rectification column. Provision can also be made here fora portion of this sump liquid to be used to cool a head condenser of an additionally present argon column (i.e., a "fourth" column as explained below) and to feed it into the second rectification column only thereafter. By contrast, an additional portion can be transferred directly into the second rectification column while bypassing such a head condenser.

As mentioned, the third rectification column in particular receives, as a gaseous feed flow, air which was previously expanded in an expansion machine. In other words, the previously compressed and cooled air, which is expanded by means of an expansion machine, can in particular be supplied to the third rectification column. It goes without saying that this is additional air which is subjected to separation in the method or in the unit in addition to the air fed into the first rectification column.

About in the middle of the third rectification column, more generally in a region between the sump and head, it is optionally also possible to draw an additional liquid material flow from the third rectification column, which material flow can in particular be returned to the first rectification column by means of a pump.

As mentioned, oxygen-rich fluid is formed in the sump of the second rectification column. This fluid can be drawn from the second rectification column. The withdrawal can take place partially in gaseous form and partially in liquid form. This fluid typically has an oxygen content of more than 97 mole percent, in particular more than 99.0 mole percent. Additional fluid can be drawn from the head of the second rectification column and in one embodiment of the invention can be discharged from the air separation unit and discarded. This is a nitrogen-oxygen mixture. In another embodiment of the present invention, however, the head gas of the second rectification column is formed as an additional nitrogen-rich fluid and provided as an additional nitrogen-rich air product.

The head gas of the second rectification column can be obtained with higher purity by drawing a gaseous partial flow slightly below the head of the second rectification column. By drawing this partial flow, a nitrogen product with typically only approximately 1 ppm, at most 100 ppm, oxygen is produced at the head of the second rectification column analogously to the procedure in a conventional air separation unit.

This product can either be heated or partially heated directly in the main heat exchanger to a temperature level at or near the ambient temperature and compressed in a hot compressor to a pressure level of, for example, approximately 1.7 to 2.5 bar, in particular approximately 2.2 bar. In the course of heating, this product, or a partial flow thereof, can also be drawn from the main heat exchanger at an intermediate temperature level, conducted through a cold compressor, and resupplied to the main heat exchanger and heated further. The compression in the hot compressor may follow. The cold compressor can in particular be coupled to an expansion machine which expands compressed and partially cooled feed air which is fed into the third rectification column. In this connection, a nitrogen-rich liquid return flow to the second rectification column can, in particular, be used.

In a corresponding embodiment, the invention is distinguished in particular in that nitrogen-rich head gas is formed at the head of the second rectification column, and that at least one fraction of the nitrogen-rich head gas as an additional nitrogen-rich air product having a residual oxygen content which is above the residual oxygen content of the head gas of the first rectification column but still significantly below the residual oxygen content of fluids which are drawn at the head from these oxygen columns in regular SPECTRA methods with oxygen columns. In the context of this embodiment of the present invention, this can also be made possible in particular by installing additional bottoms or packing regions in the second rectification column in comparison to customary oxygen columns, by drawing an additional fluid below them, and by adding a liquid nitrogen-rich return flow at the head of the second rectification column.

In the context of the present invention, the head gas of the first rectification column has a residual oxygen content of 0.1 ppb to 10 ppm, more particularly 0.5 ppb to 1 ppm or up to 100 ppb. The residual oxygen content of the at least one nitrogen-rich air product which is provided in the context of the present invention and which is formed using this head gas is therefore in this range. In the just mentioned embodiment of the present invention, the residual oxygen content of the head gas of the second rectification column is above this range. This residual oxygen content is in particular 10 ppb to 100 ppm, in particular 100 ppb or 500 ppb to 10 ppm. The residual oxygen content of the additional nitrogen-rich air product provided in the context of the present invention using this head gas is therefore in this range. All specifications in ppb or ppm designate the mole fraction.

The residual oxygen content, achieved in the mentioned embodiment of the invention, of the additional nitrogen-rich air product which is provided using the head gas of the second rectification column can be achieved, as mentioned, in particular by equipping the second rectification column with additional bottoms or packing regions. In this embodiment of the present invention, the second rectification column therefore preferably has from 50 to 120, for example 70 to 95, in particular 72 to 90, theoretical bottoms.

As also mentioned, the residual oxygen content, achieved in the mentioned embodiment of the invention, of the additional nitrogen-rich air product which is provided using the head gas of the second rectification column can in particular nevertheless achieve the use of a nitrogen-rich liquid return flow to the second rectification column. The provision of a nitrogen-rich liquid material flow and its addition as a return flow in an upper region of the second rectification column is therefore provided in the context of a particularly preferred embodiment of the present invention. The return flow has a residual oxygen content which is in particular lower than the residual oxygen content of the head gas of the second rectification column.

The nitrogen-rich liquid material flow which is used in this embodiment of the present invention to form the return flow to the second rectification column can in particular be drawn from the first rectification column or an additional rectification column.

In particular for supplying semiconductor fabrication plants (so-called fabs), in addition to gaseous, high-purity and possibly particulate-free nitrogen and optionally oxygen, the supply with comparatively small quantities of gaseous argon is also increasingly desired. For this purpose, either liquid argon can be delivered or evaporated on site, or gaseous argon can be produced on site. The delivery of liquid argon not only entails economic disadvantages (transport costs, refill losses, cold losses from evaporation against ambient air), but also places high demands on the reliability of the logistics chain. Units for low-temperature air separation, which, in addition to larger quantities of gaseous, high-purity nitrogen, can also supply smaller quantities of gaseous argon are therefore increasingly demanded for the named fields of application. The produced nitrogen should typically have only approximately 1 ppb, at most 1000 ppb, of oxygen, be substantially without particulates, and be able to be supplied at a distinctly superatmospheric pressure level.

For the extraction of argon, air separation units with double-column systems and so-called crude argon columns and optionally so-called pure argon columns are typically used. An example is illustrated in Haring (see above) in FIG. 2.3A and described starting on page 26 in the section "Rectification in the Low-pressure, Crude and Pure Argon Column" and also starting on page 29 in the section "Cryogenic Production of Pure Argon." As explained therein, argon accumulates in corresponding units at a certain height in the low-pressure column (so-called argon maximum). At this or at another favorable point, optionally also below the argon maximum (at the so-called argon transition), argon-enriched gas with an argon concentration of typically 5 to 15 mole percent can be withdrawn from the low-pressure column and transferred to the crude argon column. A corresponding gas typically contains approximately 0.05 to 100 ppm of nitrogen and otherwise substantially oxygen. It should be explicitly emphasized that the stated values for the gas withdrawn from the low-pressure column represent only typical example values.

The crude argon column serves substantially to separate off the oxygen from the gas withdrawn from the low-pressure column. The oxygen separated off in the crude argon column or a corresponding oxygen-rich fluid can be returned to the low-pressure column in liquid form. The oxygen or the oxygen-rich fluid is typically fed into the low-pressure column a plurality of theoretical or practical bottoms below the feed point for the oxygen-enriched, nitrogen-depleted, and optionally at least partially evaporated liquid withdrawn from the high-pressure column. A gaseous fraction which remains in the crude argon column during the separation and contains substantially argon and nitrogen is further separated in the pure argon column to obtain pure argon. The crude argon column and the pure argon column have head condensers which can be cooled in particular with a portion of the oxygen-enriched, nitrogen-depleted liquid withdrawn from the high-pressure column, which liquid partially evaporates during this cooling. Other fluids can also be used for cooling.

In principle, a pure argon column can also be dispensed with in corresponding units. In this case, the unit is typically designed or operated in such a way that the nitrogen content at the argon transition is below 1 ppm or below the required product purity. However, this is not a mandatory requirement. Argon of the same quality as from a conventional pure argon column is in this case typically withdrawn from the crude argon column or a comparable column slightly further down than the fluid conventionally transferred to the pure argon column, wherein the bottoms in the section between the crude argon condenser, i.e., the head condenser of the crude argon column, and a corresponding offtake for an argon product in particular serve as barrier bottoms for nitrogen.

Even if only comparatively small quantities of argon are demanded, a complete air separation unit with argon rectification (i.e., equipped with a conventional low-pressure column for oxygen extraction), as explained above, must conventionally still be installed for the production of the gaseous argon. The quantity of air to be processed in such an air separation unit is determined by gaseous argon or gaseous nitrogen, i.e., a large quantity of the gaseous oxygen is obtained as a residual gas which is not or only poorly usable. Furthermore, in conventional units, it is not possible to produce nitrogen at a distinctly superatmospheric pressure level with simultaneously large production quantities. The nitrogen is obtained as a low-pressure product here. Known units in which the high-pressure column is used for nitrogen production are typically not well suited for argon production.

In a particularly preferred embodiment, the present invention now proposes a method and an air separation unit by means of which, in addition to larger quantities of high-purity, gaseous nitrogen at a distinctly superatmospheric pressure level, comparatively lower quantities of argon can also be provided in an advantageous manner.

In the context of the present invention, according to this particularly preferred embodiment, fluid is drawn from the second rectification column for obtaining argon and is used as a third material flow or to form a third material flow, this fluid having a higher argon content than the oxygen-rich sump liquid which is formed in the sump of the second rectification column. This fluid also has a lower oxygen content than the oxygen-rich sump liquid which is formed in the sump of the second rectification column. In particular, it may have 45 to 60 mole percent oxygen, 40 to 55 mole percent argon, and less than 1 mole percent nitrogen. The fluid which is drawn in from the second rectification column and used as the third material flow or to form the third material flow can be drawn at the height of the so-called argon maximum as occurs in known low-pressure columns of air separation units.

In this embodiment, a fourth rectification column is used, into which the third material flow is fed, wherein an argon-rich fluid which has a content of more than 95 mole percent argon and which can be used, in particular, directly or after further purification as an argon product is formed in the fourth rectification column.

A content of less than 1 ppm nitrogen in the third material flow can be achieved in particular in that a corresponding separation of nitrogen takes place by means of suitable additional bottoms above the argon transition in the second column. If the fluid drawn from the second rectification column and used to form the third material flow has a correspondingly low nitrogen content, it can be provided as product of the fourth rectification column, in particular without using a conventional pure argon column. If the nitrogen content is significantly higher, a pure argon column is typically used in addition to a corresponding fourth rectification column which then corresponds to a conventional crude argon column. Alternatively to the use of a pure argon column, liquid argon can also be withdrawn slightly below the head of the fourth rectification column as the fluid conventionally transferred into the pure argon column so that argon of the same quality as from a conventional pure argon column can be obtained in this way.

In each case, the fourth rectification column is a rectification column which corresponds broadly to the typical crude argon column of a conventional method for low-temperature air separation. If necessary, a pure argon column may optionally be provided. In the case of the previously explained low nitrogen contents, however, a pure argon column can typically be dispensed with. If the nitrogen content is higher than the mentioned 1 ppm, the content of oxygen and argon may be correspondingly lower. Here, the contents of oxygen are typically also 45 to 60 mole percent and the content of argon is 40 to 55 mole percent, in this case however relative to the non-nitrogen content of a corresponding fluid.

The third material flow, which is fed into the fourth rectification column, may in particular also be a material flow which is drawn from an additional rectification column which in turn is fed with fluid from the second rectification column. Reference is made to the explanations below. In this case as well, however, the fluid which is drawn from the second rectification column is used to form the fourth material flow, namely via the detour of the additional rectification column.

By separating argon, impure oxygen (with 90 to 98% mole percent oxygen content), technical oxygen (with 98 to 99.8% mole percent oxygen content), and high-purity oxygen (with traces of argon or hydrocarbons in the ppb range) can be produced as additional products in the context of a corresponding embodiment of the present invention, as also explained in part below.

In principle, in the context of the present invention, oxygen an oxygen product can also always be drawn from the second rectification column even if, for example, a third rectification column is provided for oxygen production. For example, an oxygen-rich gas can be drawn from the second rectification column and (in contrast to the admixture to other flows, as illustrated in FIG. 31, for example) conducted separately through the main heat exchanger and discharged from the unit as a product. In this way, oxygen with a purity of 99% and better is obtained, which corresponds to the purity of so-called technical oxygen.

In the sump of the fourth rectification column, in the explained embodiment, a sump liquid is formed which can in particular be returned to the second rectification column by means of a pump. In this case, a feed point into the second rectification column is located in particular at the same height or in the vicinity of the extraction point of the fluid which is used as the third material flow or to form the third material flow, wherein "in the vicinity" is understood here to mean a feed position which differs by no more than 10 theoretical or practical bottoms. Since the two flows from and to the fourth rectification column are in equilibrium, the return feed can also take place at the same height, i.e., in particular on the same bottom.

A particularly great advantage of the in the context of the embodiment of the present invention just explained is that by supplementing a SPECTRA method with an additional argon extraction, up to 50% of the argon contained in the process air can be obtained as a product without the need for complex conventional oxygen rectification. The problems explained above are therefore eliminated in the context of the embodiment of the present invention just explained. In the context of the present invention, liquid argon can also be obtained in particular, which can be subjected to a known internal compression. Pure oxygen formed in the unit can also be subjected to internal compression as known from the technical literature cited at the outset.

According to a particularly preferred embodiment of the present invention, the second rectification column is operated, as mentioned, with a condenser evaporator arranged in its sump region. Material flows other than those mentioned can also be used to heat the condenser evaporator. For example, in the context of the present invention, a portion of the atmospheric air which has previously been compressed and cooled can be used for this purpose. Corresponding air can be present, for example, at the pressure level of the first rectification column or can be expanded beforehand by means of an expansion machine. In the former case, the air is typically cooled by means of a main condenser of the air separation unit to a temperature level close to its liquefaction temperature, i.e., a temperature level which is no more than 50 K, 25 K, or 10 K above the liquefaction temperature. In the latter case, the air is cooled, before being expanded, only to a temperature level which is in particular below −50° C. but at least 50 K above the liquefaction temperature. In this case, the expansion typically takes place to a pressure level which is below the first pressure level at which the first rectification column is operated, typically at approximately 4 to 6 bar absolute pressure. The air used to heat the condenser evaporator liquefies at least partially and can therefore be fed into the first and/or the third rectification column in a corresponding form, wherein any pressure differences which may occur can be compensated by interposition of a pump or also by a purely hydrostatic-geodetic pressure increase.

However, one or more additional material flows can also be used to heat the condenser evaporator in the second rectification column. In particular, this can be the fluid which contains oxygen, nitrogen, and argon which is drawn from the first rectification column as the second material flow or is used to form the second material flow, and which is transferred into the second rectification column, or a portion thereof. A corresponding second liquid material flow is drawn, for example, from the first rectification column, conducted through the condenser evaporator, thereby supercooled, and then added to the second rectification column in particular below a head region, i.e., in particular below the nitrogen-rich return flow. This second material flow can thus be used as a return flow to the second rectification column. The condenser evaporator can also be operated with head gas of the third rectification column, as mentioned.

In the context of the present invention, as mentioned, a nitrogen-rich return flow to the second rectification column can be formed using nitrogen-rich liquid from the first rectification column. In this case, a corresponding material flow can be cooled in particular in the condenser evaporator of the second rectification column; however, it is also possible to feed a corresponding material flow into the second rectification column without being cooled. In any case, this material flow is advantageously drawn from the first rectification column significantly above the second material flow. The withdrawal typically takes place in the region of 20 theoretical or practical bottoms below the head region of the first rectification column.

In the context of the present invention, head gas is drawn from the second rectification column and, in particular, discharged from the air separation unit, as already explained above in different embodiments. According to one embodiment of the present invention, at least one portion of this head gas is expanded by means of an additional expansion machine, heated, and discharged from the air separation unit.

In the context of the present invention, the second rectification column can, as mentioned, be operated at the second pressure level, in particular at a pressure level of 1.1 to 1.6 bar absolute pressure, wherein previously compressed and cooled air is supplied to the first rectification column, a partial flow of which air is expanded by means of an expansion machine to the second pressure level at which the second rectification column is operated. After its expansion in the condenser evaporator which is arranged in the sump region of the second rectification column, this partial flow can be at least partially liquefied and fed into the first rectification column. Such an embodiment has the advantage that both the argon yield and the total energy range are significantly improved. The expansion machine used for this expansion may be coupled to a compressor which, in the previously explained embodiment of the invention, heats and compresses the additional air product, which is formed using head gas of the second rectification column. In addition or as an alternative to such a coupling, braking, for example by means of a generator and/or by means of an oil brake, can also be provided. In one embodiment of the present invention, however, additional fluid can also be expanded by means of a comparable additional expansion machine.

In general, in the context of the present invention, the fourth rectification column, in the embodiments in which it is present, can be operated with a head condenser whose evaporation chamber is operated at a pressure level of less than 1.2 bar absolute pressure or 150 mbar overpressure and cooled with fluid which is subsequently fed into the second rectification column or discharged from the air separation unit. This fluid can in particular be a sump liquid of the first or, if present, the third rectification column, or a corresponding fluid can comprise a portion of this/these sump liquid(s). However, additional fluids may also be used. Such an operating pressure level of the evaporation chamber of the head condenser can increase the argon yield in the context of the invention. This can be made possible in particular in that corresponding fluid is not used as regeneration gas in the air separation unit.

In particular, in the context of the present invention or of a corresponding embodiment, a fraction of the fluid which accumulates in the sump of a rectification column, in particular of the first or the third rectification column, can thus be used in the head condenser as the fluid or as a portion of the fluid by means of which the head condenser of the fourth rectification column is cooled. As mentioned, corresponding fluid can in particular subsequently be discharged from the air separation unit or advantageously used in some other way.

In the context of a corresponding embodiment of the present invention, head gas formed in the fourth rectification column may in particular have a content of more than 99.999 mole percent argon. In this embodiment, this head gas can be discharged as an argon product from the air separation unit without further rectification. As mentioned, correspondingly high argon contents result in particular when an extremely nitrogen-poor fluid is drawn from the second rectification column and transferred into the fourth rectification column.

Alternatively, it is also possible to form a head gas in a corresponding embodiment in the fourth rectification column with a lower argon content, e.g., with an argon content of more than 95 and less than 99.999 mole percent. In this embodiment, it is then possible in particular to provide an additional rectification column in the form of a known pure argon column, in which this head gas can subsequently be rectified to obtain an argon product having a corresponding purity of more than 99.999 mole percent. Regarding known crude and pure argon columns, reference is made to the technical literature cited at the outset.

However, as also mentioned, in corresponding embodiments, instead of the head gas, an argon-rich fluid in liquid form can also be withdrawn from the third rectification column below the head thereof in the form of the fifth material flow.

In the context of the present invention, as mentioned several times, a quantity of the argon product formed in the air separation unit may comprise 1% to 50% of an entire argon quantity supplied overall in the form of atmospheric air to the air separation unit.

According to a variant of the method according to the invention, for the production of ultrahigh-purity oxygen having an oxygen content of, for example, 99.5 mole percent with a residual content of up to 1 ppb of methane, 10 ppb of argon, and no more than 1 ppb of other air components, a fifth rectification column can be used in which a liquid is formed with an oxygen content which is above an oxygen content of the oxygen-rich sump liquid formed in the sump of the second rectification column.

This fifth rectification column can, in particular, be designed as a double column which has an upper part and a lower part which are separated from one another in a fluid-tight manner. In any case, a head gas and a sump liquid are formed in the upper part and the lower part of the double column, respectively. In this case, the upper part can be used as a barrier column against high boilers such as hydrocarbons, and is, from a functional perspective, an outsourced part of the fourth rectification column. The lower part, i.e., the fifth rectification column itself, is used as a stripping column for separating low boilers such as argon.

Overall, in the context of the present invention, a liquid having an oxygen content which is above an oxygen content of the oxygen-rich sump liquid formed in the sump of the second rectification column can be formed in the fifth rectification column or its lower part, and the fifth rectification column can be used to form the third material flow, which is fed into the fourth rectification column, using the fluid which is drawn from the second rectification column and has a higher argon content than the oxygen-rich sump liquid of the second rectification column.

At least one portion of the fluid which is drawn from the second rectification column and which is used as the fourth material flow or to form the fourth material flow can be fed into the upper part of the fifth column just explained, which is designed as a double column, i.e., into the part functionally belonging to the second rectification column.

The upper and the lower part of the double column just explained can each be operated with a return flow which is provided using sump liquid of the fourth rectification column, if present, head gas of the upper and the lower part of the double column just explained can be fed into the fourth rectification column, and the liquid with the oxygen content which is above the oxygen content of the oxygen-rich sump liquid formed in the sump of the second rectification column can be formed in the form of sump liquid of the lower part.

The invention can in particular comprise that the lower part of the double column, i.e., the fifth rectification column in the actual sense, is heated by means of a condenser evaporator in which fluid from the fourth rectification column is cooled.

The present invention also extends to an air separation unit configured to carry out a method according to a previously explained embodiment in the present invention. With respect to features and advantages of a corresponding air separation unit, reference is explicitly made to the corresponding independent claim and the above explanations. Such an air separation unit in particular has means which are configured to carry out a method according to one of the embodiments explained.

In a particularly preferred embodiment of the air separation unit proposed according to the invention, it has a main heat exchanger which is arranged in a first prefabricated cold box, and the first rectification column with the heat exchanger used to cool its head gas is arranged in a second prefabricated cold box. The second and third rectification columns in such an air separation unit are arranged in a third prefabricated cold box.

Such an air separation unit can in particular have one or more additional rectification columns, as explained above with reference to the fourth and fifth rectification columns. The one additional or at least one of the plurality of additional rectification columns can be arranged in the third prefabricated cold box or in one or more additional prefabricated cold boxes.

A cold box is an insulating container made of metal, which in each case surrounds the or all of the aforementioned apparatuses and is filled with insulating material, for example perlite. In addition to the one or more aforementioned apparatuses, the devices required for operation, such as heat exchangers and/or fittings, are advantageously arranged in the cold box so that only pipes have to be laid when a corresponding unit is constructed. This facilitates the construction at the installation site. Prefabrication comprises in particular the construction of the external cold box-type sleeve and, if applicable, the introduction of the aforementioned apparatuses with the corresponding piping. Only one (piping) connection therefore has to be made at the construction site.

The invention is described in more detail below with reference to the accompanying drawings, which illustrate preferred embodiments of the present invention.

DETAILED DESCRIPTION OF THE DRAWINGS

In the following figures, air separation units of different embodiments of the present invention are illustrated and designated by 100 to 3100. The components of corresponding units are first explained with reference to FIG. 1 and the non-inventive air separation unit 100 illustrated therein. Elements which are present in the air separation units 200 to 3100 according to FIGS. 2 to 31 and each correspond to one another structurally or functionally will not explained repeatedly in that context.

Figure 1:
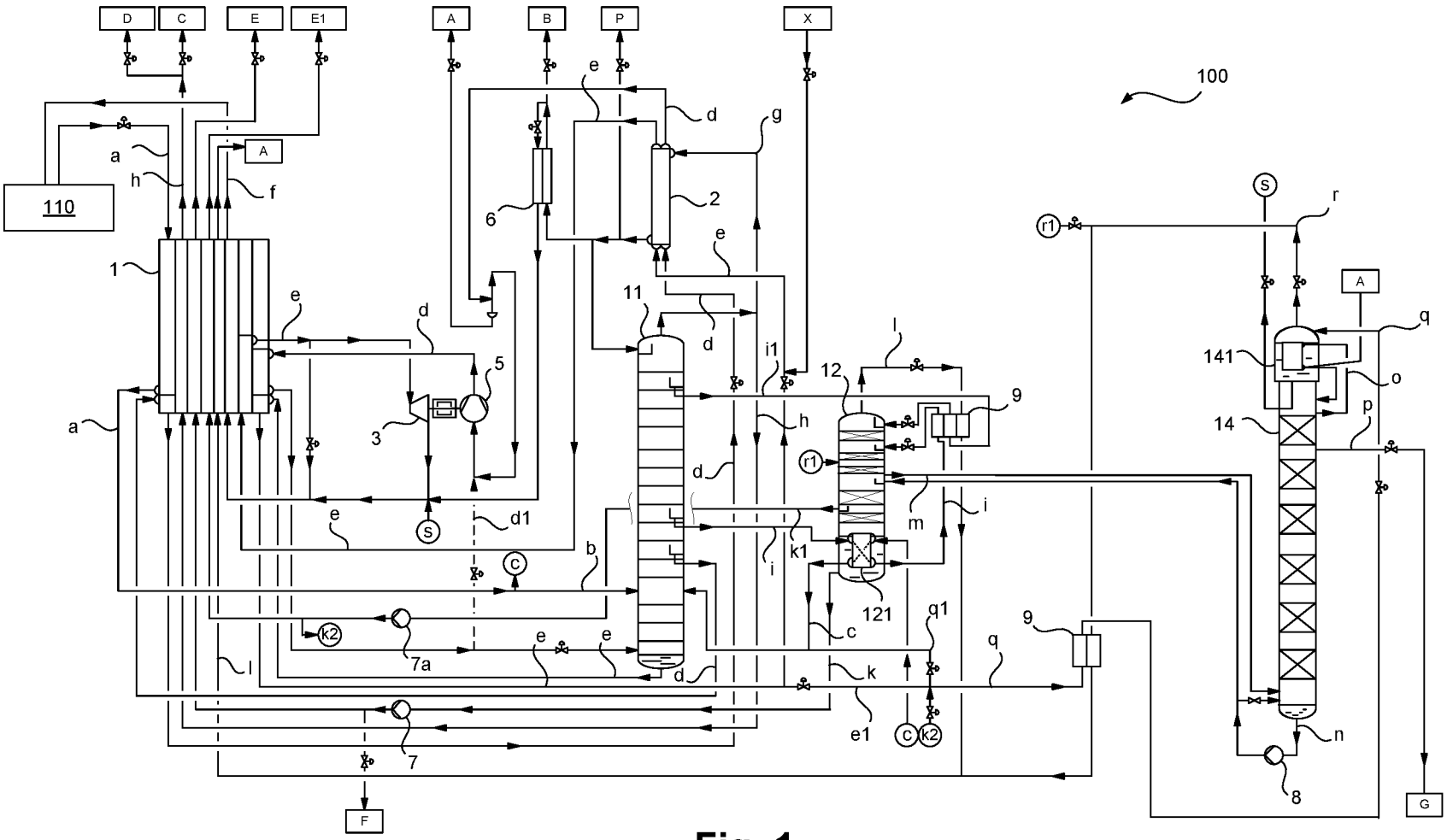
FIGS. 1 to 31 each illustrate air separation units and parts of air separation units in an overall or partial illustration.

FIG. 1 illustrates a non-inventive air separation unit 100 in the form of a schematic unit diagram.

A feed air flow a is supplied to the air separation unit 100 from a warm part of the air separation unit 100, which is illustrated schematically here as 110 and in particular comprises devices for purifying and compressing feed air. This feed air flow a is cooled in a main heat exchanger 1 of the air separation unit 100 and drawn from the main heat exchanger 1 near its cold end. The warm part 110 of the air separation unit can be of a customary design. For a non-limiting example of the present invention, reference is made to the explanations relating to FIG. 2.3A in Haring (see above).

The feed air flow a is subsequently divided into two partial flows b and c, wherein the partial flow b is fed directly into a first rectification column 11. In contrast, the partial flow c is conducted through a condenser evaporator 121 of a second rectification column 12 and then, in particular after combining with additional material flows as explained below, likewise fed into the first rectification column 11. The partial flows b and c are each fed into the first rectification column 11 at a suitable height.

In the first rectification column 11, which is operated at a previously explained "first" pressure level, a nitrogen-enriched or substantially nitrogen-containing head gas and an oxygen-enriched sump liquid are formed. Two material flows d and e are drawn from the first rectification column 11, and each comprise fluid which is oxygen-enriched compared to atmospheric air.

The material flow d is first cooled further in the main heat exchanger 1 and subsequently conducted through a heat exchanger 2 which, as explained below, is used to cool head gas of the first rectification column 11. The material flow e is first treated in a comparable manner to the material flow d, wherein a portion of the material flow e can be branched off as material flow e1 before the rest of the material flow e, which is further designated as e for the sake of simplicity, is supplied to the heat exchanger 2. Liquid nitrogen X can also be supplied externally to the material flow e if necessary. In the example shown, the material flow e is drawn from the sump of the first rectification column 11, whereas the material flow d is drawn from the first rectification column 11 from a position of a plurality of theoretical or practical bottoms above the sump. The material flows d and e are conducted through the heat exchanger 2 separately from one another.

The material flow e is subsequently partially heated in the main heat exchanger 1 and expanded in the form of two partial flows by means of an expansion machine 3 and optionally by means of a bypass valve which is not designated separately. These partial flows, subsequently combined with one another and with additional material flows, are heated in the main heat exchanger 1 and are discharged from the air separation unit in the form of a collection flow f, or are used in the warm part 110, for example for regenerating absorbers.

On the other hand, optionally after branching off and blowing off a partial flow into the atmosphere A, the material flow d is compressed in a compressor 5 which is coupled to one of the expansion machines 3 shown here, subsequently cooled, and returned to the first rectification column 11 in a manner comparable to the material flow c. As illustrated in the form of a dashed material flow dl, a bypass can also take place here. The compressor 5 is coupled to the expansion machine 3 and furthermore has an oil brake not designated separately here.

Head gas from the head of the first rectification column 11 is conducted through the heat exchanger 2 in the form of a material flow g and is at least partially liquefied there. This partially liquefied head gas can be partially returned to the first rectification column 11 in the form of a return flow, and an additional fraction thereof can be provided as liquid nitrogen product B. For this purpose, a portion can be supercooled in a sub-cooler 6 and discharged as a correspondingly supercooled liquid nitrogen product B. A fraction expanded in the sub-cooler 6 for cooling can be combined with the already mentioned material flow e. A portion of the material flow g can also be discharged as a so-called purge P. Further head gas can be heated in the form of a material flow h in the main heat exchanger 1 and discharged as gaseous nitrogen product C or used as sealing gas D. The gaseous nitrogen product C represents a "nitrogen-rich air product" previously explained with respect to different embodiments of the invention.

In the example illustrated in FIG. 1, a material flow i is conducted in liquid form from the first rectification column 11, is supercooled in the condenser evaporator 121 of the second rectification column, and added as a return flow to the second rectification column 12. From a region close to the head of the first rectification column 11, in any case significantly above the material flow i, an additional, correspondingly nitrogen-rich material flow i1 is withdrawn in liquid form and added as a return flow to the second rectification column 12 above the material flow i, in particular at the head.

From the sump of the second rectification column 12, a liquid oxygen-rich material flow k can be withdrawn, which can be pressurized by means of an internal compression pump 7 or by means of pressure buildup evaporation and can subsequently be heated in the main heat exchanger 1 and provided as an internally compressed oxygen pressure product E. A portion of the material flow k may also be provided as a liquid oxygen product F. Additional oxygen-rich liquid, but with a lower oxygen content, can analogously be withdrawn from the second rectification column 12 in the form of a material flow k1, pressurized by means of an additional internal compression pump 7*a*, and provided as an additional internally compressed oxygen pressure product E1. A fraction can optionally also be returned in the form of a material flow k2. A portion may also be provided as a liquid oxygen product F. In the example shown, a material flow l is withdrawn from the head of the second rectification column 12 and, after being combined with an additional material flow, can likewise be heated and, in the illustrated example, discharged to the atmosphere A. The material flows i and i1 are supercooled in a sub-cooler 9 against the material flow l before they are fed into the second rectification column 12.

From a central region of the second rectification column 12, in particular at the argon transition, a material flow m is withdrawn which is fed into a lower region of a rectification column 14 which is referred to as fourth rectification column 14 for consistency reasons (in the non-inventive embodiment illustrated here, the third rectification column 13 used according to the invention is not present). By means of a pump 8, an additional material flow n is withdrawn from the sump of the fourth rectification column 14 and returned to the second rectification column 12. A material flow o is withdrawn from the fourth rectification column 14 in an upper region, is conducted through a head condenser 141 of the fourth rectification column 141, is at least partially liquefied there, and is returned as a return flow to the fourth rectification column 14. A non-evaporated fraction may be discharged to the atmosphere A. A liquid argon product G is withdrawn in liquid form below the head of the fourth rectification column 14 in the form of a material flow p. A corresponding material flow p can also be at least partially pressurized by means of a pump and heated in the main heat exchanger 1 so that an internally compressed argon product can be provided in this way.

The head condenser 141 of the fourth rectification column 14 is cooled with liquid which can be supplied to the head condenser 141 in the form of the already mentioned material flow q. The material flow q can be formed using at least one portion of the likewise already mentioned material flow e1 and optionally the material flow k2. Fractions not used to form the material flow q can be combined in the form of a material flow q1 with the material flow c and fed into the first rectification column 11. A material flow r can be withdrawn from an evaporation chamber of the head condenser 141 of the fourth rectification column 14, which material flow r, after combining with the material flow l as explained with reference to this material flow l, can be heated in the main heat exchanger 1, preferably without back pressure or substantially without back pressure, and discharged from the unit. In this way, a low pressure can be adjusted in the evaporation chamber of the head condenser 141. Optionally, a fraction r1 of the material flow r can also be fed into the second rectification column 12. Liquid from the evaporation chamber of the head condenser 141 of the fourth rectification column 14 can, if necessary, be combined in the form of a material flow s with the partial flows of the material flow e before they are heated in the main heat exchanger 1.

As already mentioned, the material flows i and/or i1 can be supercooled against the material flow l in sub-coolers, designated 9 in each case, against the material flow l. The same also applies optionally to the material flow q with respect to the material flow r. A plurality of sub-coolers 9 can also be combined in one common apparatus.

Figure 2:
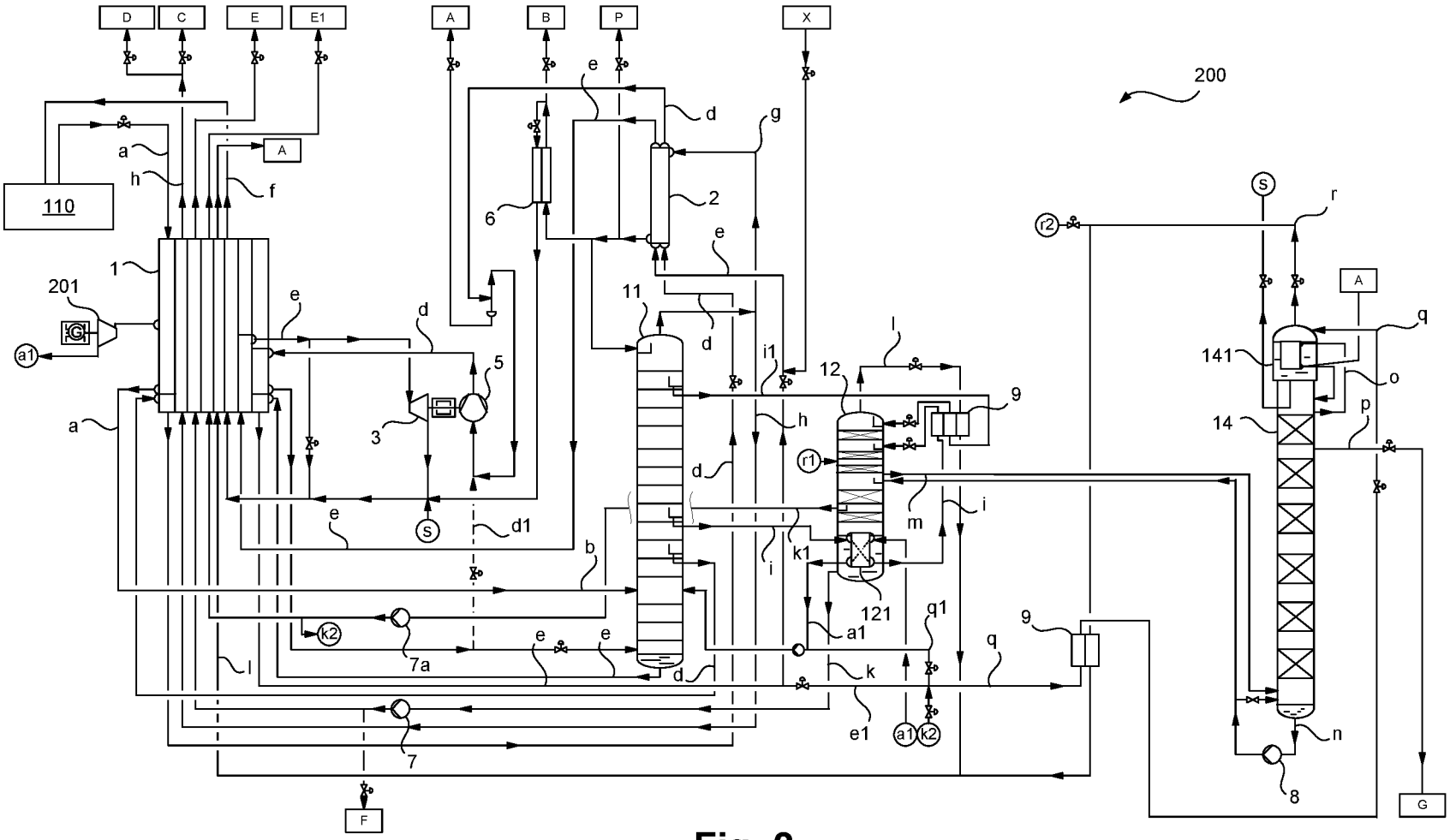

In FIG. 2, another non-inventive air separation unit is illustrated in the form of a schematic unit diagram and is designated by 200 as a whole.

In contrast to the air separation unit 100 illustrated in FIG. 1, a partial flow a1 of the feed air flow a is drawn from the main heat exchanger 1 at an intermediate temperature level, is expanded by means of an expansion machine 201 coupled to a generator, and is otherwise used like the material flow c according to FIG. 1. If a corresponding expansion machine is present and is used for the same or a comparable purpose, it is also designated as 201 in the following figures. The features deviating from the air separation unit 100 can be provided individually or together and/or combined with any features described above and below.

Figure 3:
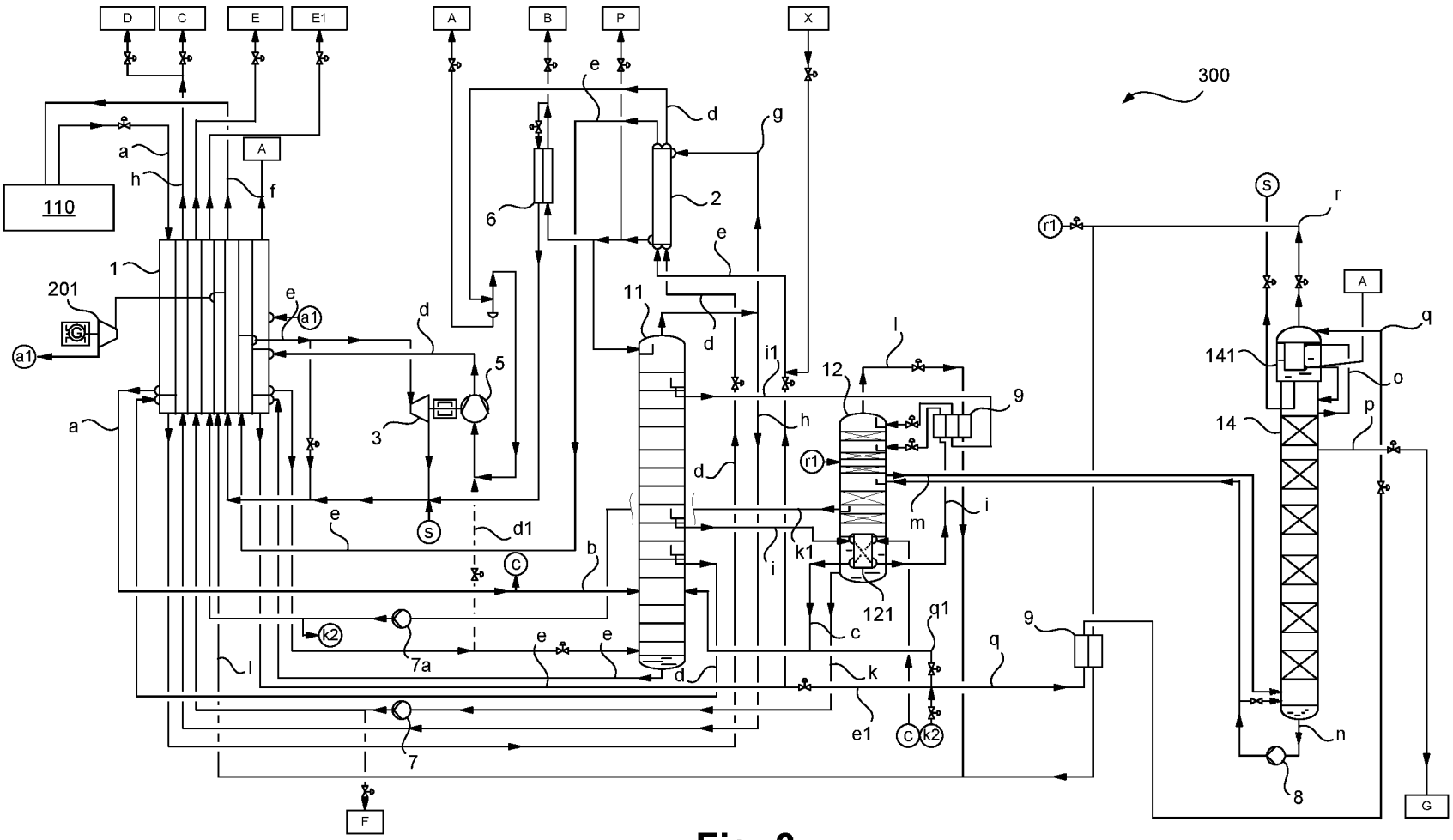

In FIG. 3, another non-inventive air separation unit is illustrated in the form of a schematic unit diagram and is designated by 300 as a whole.

As illustrated here, a material flow corresponding to the material flow a1 of FIG. 2, after it has been expanded in the expansion machine 201, can also be resupplied to the main heat exchanger 1, be heated there, and blown off to the atmosphere A. With regard to further details, reference is expressly made to the explanations relating to the preceding figures. The features deviating from the preceding figures can also be provided individually or together here and/or be combined with any features described above and below.

Figure 4:
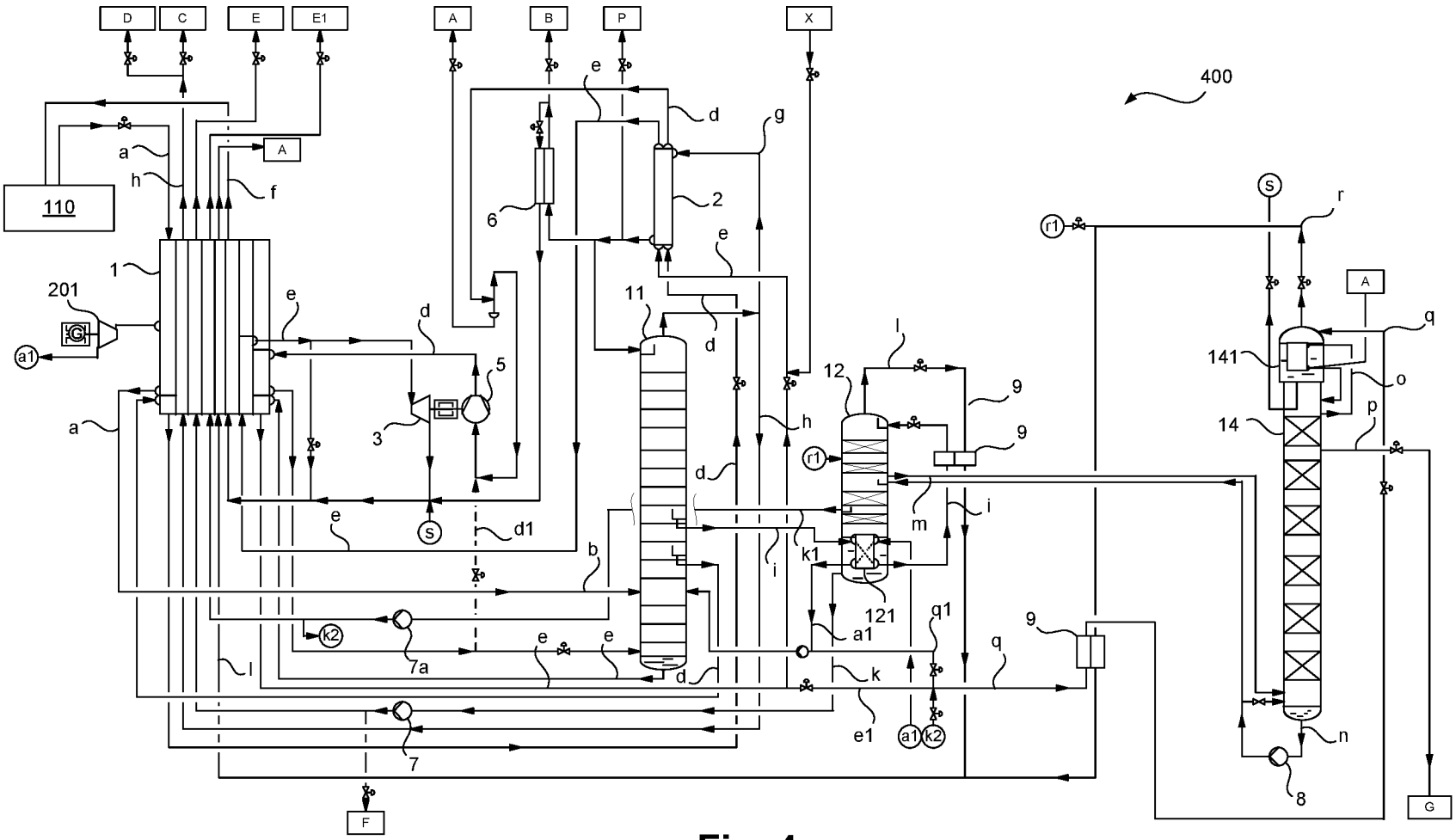

In FIG. 4, another non-inventive air separation unit is illustrated in the form of a schematic unit diagram and is designated by 400 as a whole.

In contrast to the air separation units 100 to 300 illustrated in the preceding figures, a material flow corresponding to the material flow i1 is not used here. With regard to further details, reference is expressly made to the explanations relating to the preceding figures. The features deviating from the preceding figures can also be provided individually or together here and/or be combined with any features described above and below.

Figure 5:
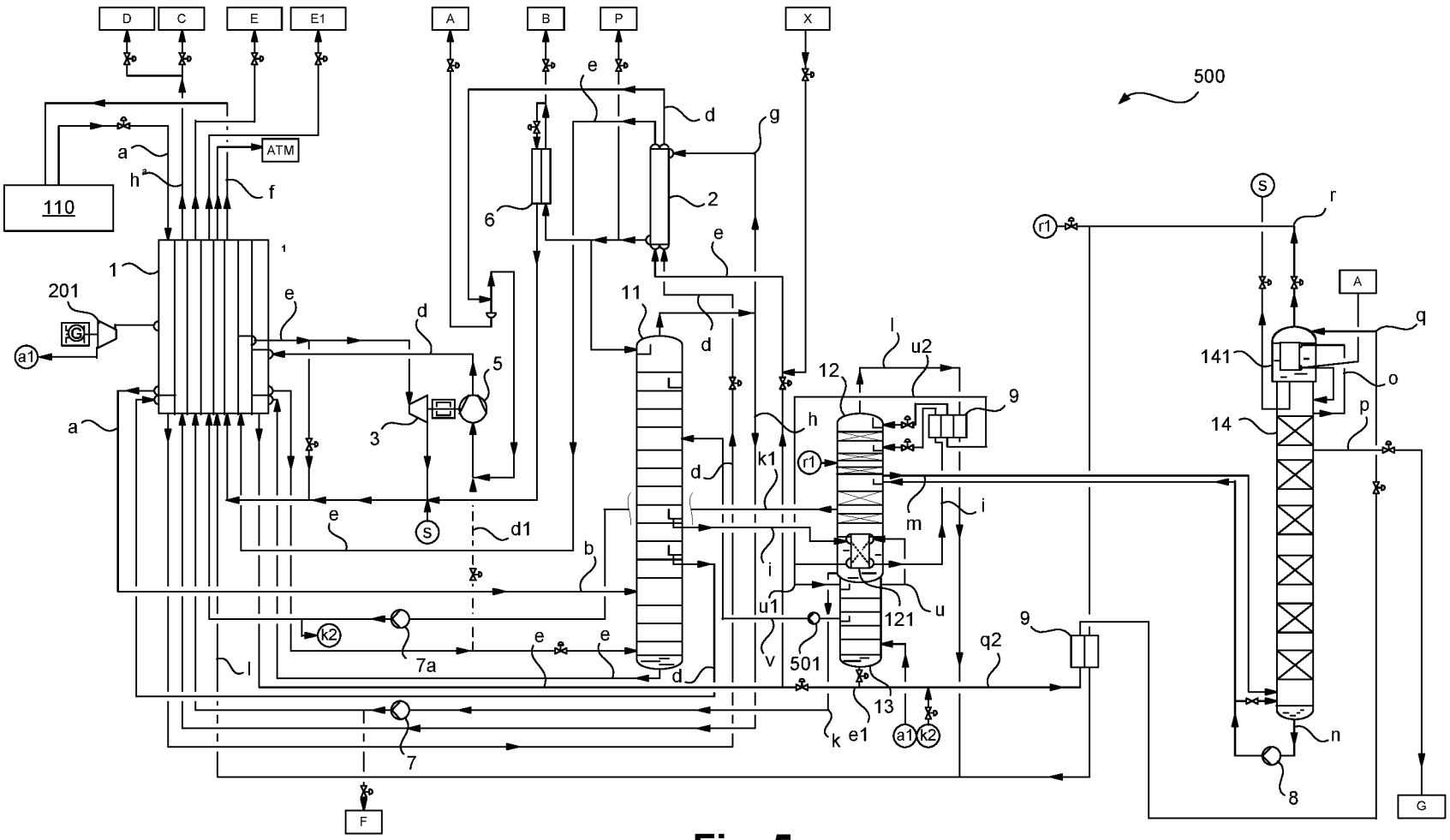

In FIG. 5, an air separation unit according to an embodiment of the present invention is shown in the form of a schematic unit diagram and is designated overall as 500.

The air separation unit 500 according to FIG. 5 differs from the previously explained embodiments in particular in that the second rectification column 12 is formed as part of a double column which additionally has the third rectification column 13 already mentioned. A fraction, previously designated a1 and correspondingly treated, of the feed air flow a is fed into a lower region of this third rectification column 13.

A material flow q2, which is otherwise further used in a manner comparable to the material flow q of the preceding figures and is therefore also designated here as q further downstream, is formed in the air separation unit 500 using sump liquid of the third rectification column 13, of the partial flow e2, and optionally of the material flow k2. Head gas of the third rectification column 13 is at least partially liquefied in the form of a material flow u in the condenser evaporator 121 and is subsequently used in the form of a partial flow u1 as a return flow to the third rectification column 13, and in the form of a partial flow u2 as a return flow to the second rectification column 12.

Nitrogen-rich liquid is drawn from the third rectification column 13 in the form of a material flow v via a side offtake and conveyed into the first rectification column 11 by means of a pump 501.

With regard to further details, reference is expressly made to the explanations relating to the preceding figures. The features deviating from the preceding figures can also be provided individually or together here and/or be combined with any features described above and below.

Figure 6:
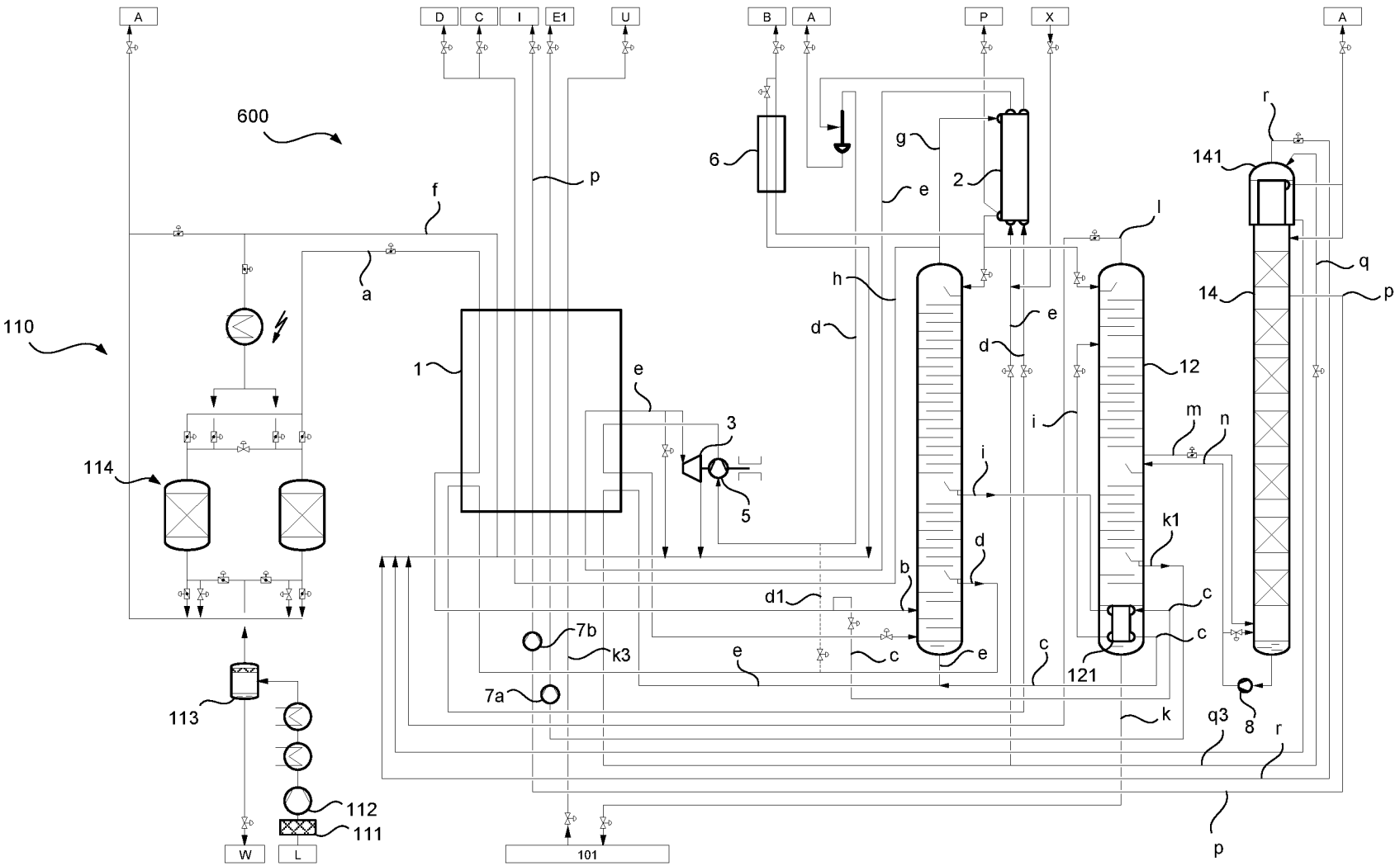

In FIG. 6, another non-inventive air separation unit is illustrated in the form of a schematic unit diagram and is designated by 600 as a whole. The illustration in FIG. 6 and the subsequent figures deviates slightly from those in FIGS. 1 to 5, but a part of the function of the shown elements is identical or comparable with regard to the technical function and is therefore indicated with identical reference signs.

From a warm part, which is also summarized here as 110, a feed air flow a, which is formed from atmospheric air L, is also supplied here to the air separation unit 600. In the warm part 110, a filter 111 via which feed air L is drawn in, a main air compressor 112 with aftercoolers not separately designated, a direct contact cooler operated with water W, and an absorber set 115 are inter alia illustrated here. The feed air flow a is also cooled here in a main heat exchanger 1 of the air separation unit 600 and drawn from the main heat exchanger 1 near its cold end.

As before, the feed air flow a is divided into two partial flows b and c, wherein the partial flow b is fed directly into the first rectification column, also designated here by 11. The second partial flow c is in turn conducted through a condenser evaporator 121 of a second rectification column 12 which is also designated here by 12 but is subsequently discharged here from the air separation unit 600 as explained below. In contrast to the condenser evaporator 121 illustrated in FIGS. 1 to 5, the flow routing in the condenser evaporator 121 according to FIG. 6 is not illustrated as being crossed.

In the first rectification column 11, which is also operated at the previously explained "first" pressure level here, a nitrogen-enriched or substantially nitrogen-containing head gas and an oxygen-enriched sump liquid are formed. Two material flows d and e are also drawn from the first rectification column 11 here and respectively comprise fluid which is oxygen-enriched compared to atmospheric air.

The material flow d is first cooled further in the main heat exchanger 1 and subsequently conducted through a heat exchanger 2 which, as explained below, is used to cool head gas of the first rectification column 11. The material flow e is first treated in a comparable manner to the material flow d, wherein the material flow e is first combined here with the material flow c, and an additional material flow q3 is subsequently branched off therefrom. Only then is this material flow, still designated by e for the sake of simplicity, further cooled in the main heat exchanger 1 and supplied to the heat exchanger 2. The material flow q3 is designated by q hereinafter for comparability with the previous figures and because of its corresponding use.

Liquid nitrogen X can be fed to the material flow e as before, if necessary. In the example shown, the material flow e is drawn from the sump of the first rectification column 11, whereas the material flow d is drawn from the first rectification column 11 from a position of a plurality of theoretical or practical bottoms above the sump. The material flows d and e are conducted through the heat exchanger 2 separately from one another.

The material flow e is subsequently partially heated in the main heat exchanger 1 and expanded in the form of two partial flows by means of an expansion machine 3 and optionally an expansion valve or via a bypass. These partial flows are subsequently combined with one another and with additional material flows, are heated in the main heat exchanger 1, and are discharged from the air separation unit in the form of a collection flow f or are used in the warm part 110 of the air separation unit 600, for example for regenerating the absorber of the absorber set 114.

On the other hand, after branching off and blowing off a partial flow to the atmosphere A, the material flow d is optionally compressed in a compressor 5 which is coupled to one of the expansion machines 3 shown here, subsequently cooled, and returned to the first rectification column. As illustrated in the form of a dashed material flow dl, a bypass can also take place here. The compressor 5 is coupled to the expansion machine 3 and furthermore has an oil brake not designated separately here. Any other combinations are also possible.

Head gas from the head of the first rectification column 11 is conducted through the heat exchanger 2 in the form of a material flow g and is at least partially liquefied there. This partially liquefied head gas can be partially returned to the first rectification column in the form of a return flow, and an additional fraction thereof can be provided as liquid nitrogen product B. For this purpose, a portion can be supercooled in a sub-cooler 6 and discharged as a correspondingly supercooled liquid nitrogen product B. A fraction expanded in the sub-cooler 6 for cooling can be combined with the already mentioned material flow e. A portion can also be discharged as a so-called purge P. Further head gas can be heated in the form of a material flow h in the main heat exchanger 1 and discharged as gaseous nitrogen product C or used as sealing gas D.

Also in the example illustrated in FIG. 6, a material flow i is discharged in liquid form from the first rectification column 11, is supercooled in the condenser evaporator 121 of the second rectification column 120, and supplied as a return flow to the second rectification column 12.

From the sump of the second rectification column 12, a liquid oxygen-rich material flow k can be withdrawn, which is fed here in liquid form into a tank system 101. From the tank system 101 or another tank, a corresponding liquid oxygen-rich material flow, here designated by k3, may be withdrawn, and may subsequently be heated in the main heat exchanger 1 and provided as gaseous oxygen product U. The second rectification column 12 can in particular be designed and operated in such a way that an ultrahigh-purity oxygen product U with the specifications explained above can be provided by means of said rectification column. This does not have to be the case with the second rectification columns 12 of the air separation units 100 to 500.

Additional oxygen-rich liquid can be withdrawn from the second rectification column 12 analogously in the form of a material flow k1, pressurized by means of an internal compression pump 7*a*, and provided as an internally compressed oxygen pressure product E1. In the example shown, a material flow l is withdrawn from the head of the second rectification column 12 and is also used here to form the already mentioned material flow f.

A material flow m is withdrawn from a central region of the second rectification column 12, in particular at the argon transition, and is fed into a lower region of a fourth rectification column also designated by 14 here. As above, an additional material flow n is withdrawn from the sump of the fourth rectification column 14 by means of a pump 8 and returned to the second rectification column 12. From the head of the fourth rectification column 14, head gas rises into a condensation chamber of a head condenser 141, is at least partially liquefied there, and returned as a return flow to the fourth rectification column 14. A non-evaporated fraction may be discharged to the atmosphere A. A material flow p is withdrawn in liquid form below the head of the fourth rectification column 14. The material flow p is pressurized by means of a pump 7*b* and is subsequently heated in the main heat exchanger 1 so that an internally compressed argon product l can be provided in this way.

The head condenser 141 of the fourth rectification column 14 is also cooled with liquid here, which can be fed to the head condenser 141 in the form of the already mentioned material flow q3, which is hereinafter designated by q. A material flow r can be withdrawn from an evaporation chamber of the head condenser 141 of the fourth rectification column 14, which material flow r, after combining with the material flow l and the material flow s (explained below) as explained with reference to this material flow l, can preferably be heated in the main heat exchanger 1 without back pressure or substantially without back pressure and discharged from the air separation unit. In this way, a low pressure can be adjusted in the evaporation chamber of the head condenser 141. Liquid from the evaporation chamber of the head condenser 141 of the fourth rectification column 14 is withdrawn here in the form of the material flow s.

Figure 7:
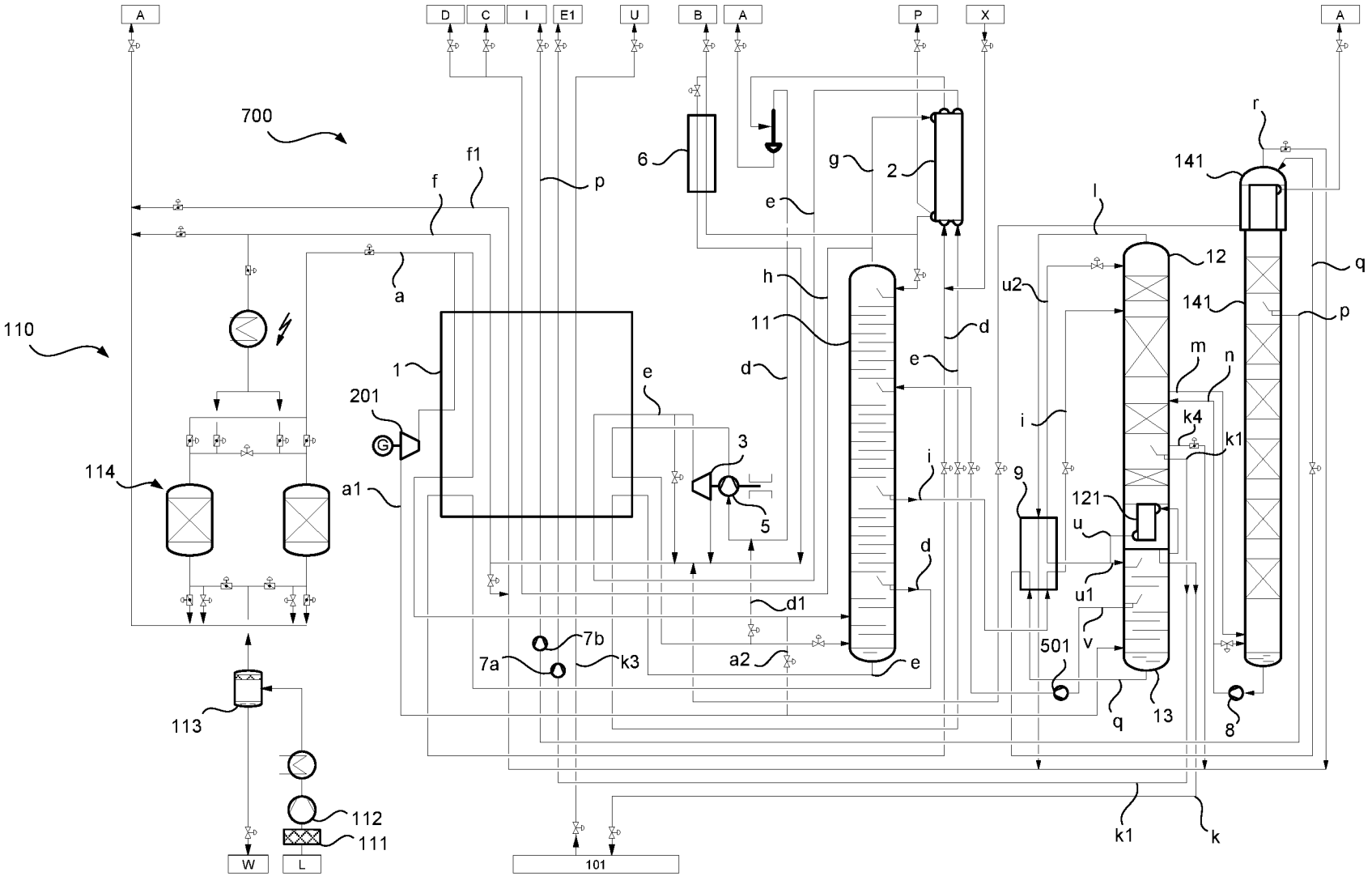

In FIG. 7, an air separation unit according to another embodiment of the present invention is shown in the form of a schematic unit diagram and is designated by 700 as a whole.

In contrast to the air separation unit 600 illustrated in FIG. 6, a partial flow of the feed air flow a, which is designated by a1 as in FIG. 2 for the first time, is drawn here from the main heat exchanger 1 at an intermediate temperature level and expanded by means of an expansion machine designated by 201 as above.

The remainder of the feed air flow a is at least partially fed into the first rectification column, wherein a cross connection a2 is provided between the partial flow a1 and the material flow a.

The air separation unit 700 illustrated in FIG. 7 is furthermore characterized in that the second rectification column 12 is designed as part of a double column which additionally has a third rectification column 13. The fraction of the feed air flow a designated by a1 and expanded is fed into a lower region of this third rectification column 13.

A material flow which is otherwise further used in a manner comparable to the material flow q of the preceding figures and is therefore also designated here by q is formed in the air separation unit 700 using sump liquid of the third rectification column 13. Head gas of the third rectification column 13 is at least partially liquefied in the form of a material flow u in the condenser evaporator 121 and is subsequently used in the form of a partial flow u1 as return flow to the third rectification column 13 and in the form of a partial flow u2 as return flow to the second rectification column 12.

Nitrogen-rich liquid is drawn from the third rectification column 13 in the form of a material flow v via a side offtake and conveyed into the first rectification column 11 by means of a pump 501. An additional material flow k4 is withdrawn from the second rectification column 12 in gaseous form and combined with the material flows l and r to form a material flow designated here by f1. Like the material flow f, the material flow f1 is heated in the main heat exchanger 1 and used correspondingly. In the shown example, the material flows q, i, and u2 are supercooled in a common sub-cooler 9 against the material flow l.

With regard to further details, reference is explicitly made to the explanations relating to the preceding figures, in particular to FIGS. 5 and 6. The features deviating from the preceding figures can also be implemented individually or together here.

Figure 8:
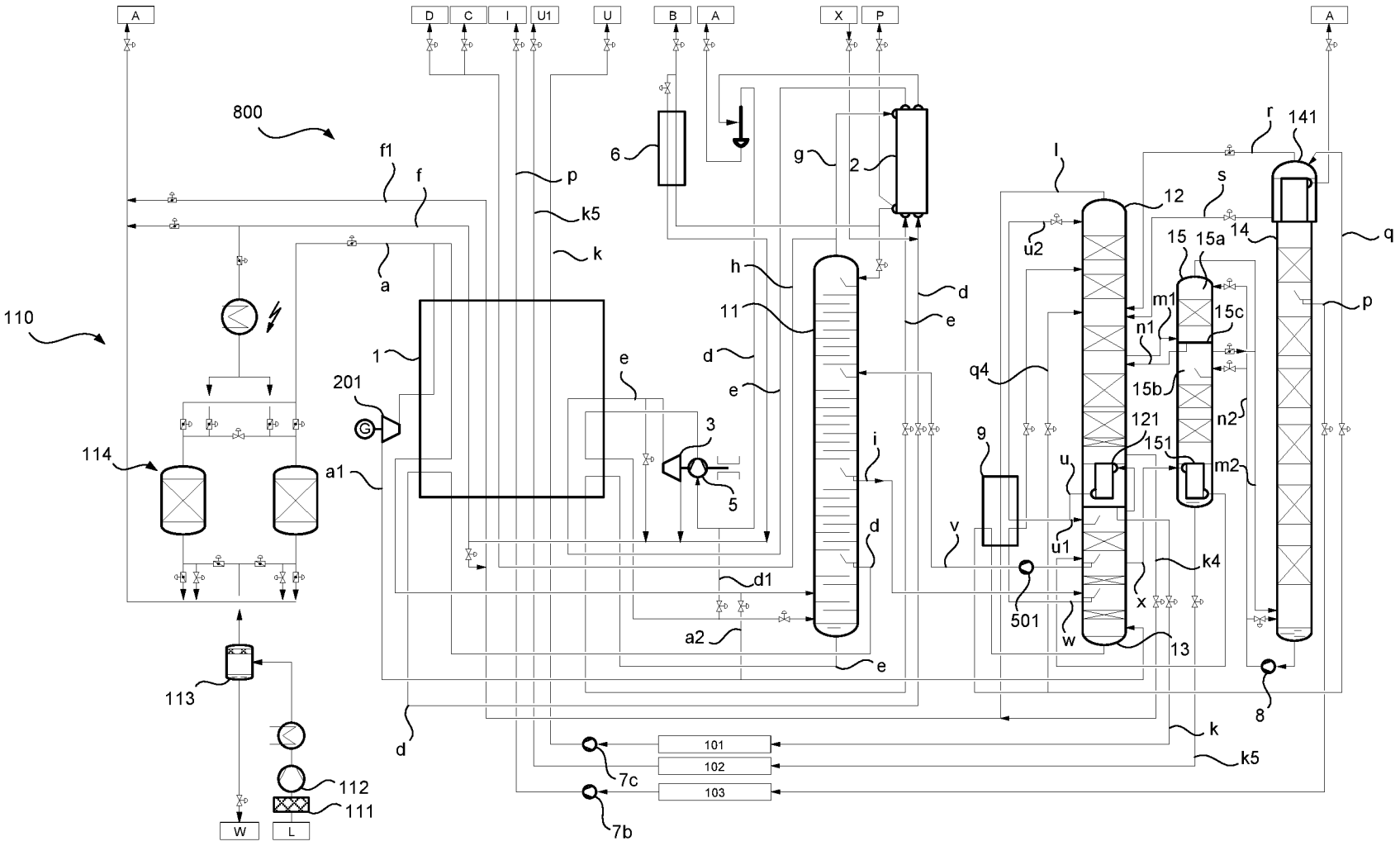

In FIG. 8, an air separation unit according to another embodiment of the present invention is shown in the form of a schematic unit diagram and is designated by 800 as a whole.

The air separation unit 800 according to FIG. 8 differs from the previously shown and explained air separation units 100 to 700 in particular in that a fifth rectification column 15 is used which is configured as a rectification column for providing high-purity oxygen.

Furthermore, in the air separation unit 800, the material flow i is fed into the third rectification column 13, and a material flow w is drawn in liquid form in a region of this feed and fed into the second rectification column 12. Here, the material flow i is thus fed into the second rectification column 12 "via the detour" of the third rectification column 13. Furthermore, a portion of the sump liquid from the third rectification column 13 is fed directly into the second rectification column 12 in the form of a material flow q4. This amounts to a bypass of the head condenser 141 of the fourth rectification column 14, which is only fed with the remaining remainder.

A material flow m1 is drawn from the second rectification column 12 and fed into an upper part 15*a* of the fifth rectification column 15, which is separated from a lower part 15*b* by a barrier bottom 15*c*. Liquid segregating on the barrier bottom 15*c* is returned into the second rectification column 12 in the form of a material flow n1. The already explained material flows r and s are fed back into the second rectification column 12. The upper part 15*a* of the fifth rectification column 15 serves in particular for discharging argon, the predominant portion of which is transferred via a material flow m2 into the fourth rectification column 14. The material flow m2 also comprises head gas of the lower part 15*b* of the fifth rectification column 15. The sump liquid of the fourth rectification column 14 is conducted in the form of a material flow m2 to the head of the upper and lower parts 15*a*, 15*b* of the fifth rectification column 15.

The fifth rectification column 15 is provided with a condenser evaporator 151, which is operated with a nitrogen-rich gas that is withdrawn from the third rectification column 13 in the form of a material flow x, at least partially liquefied in the condenser evaporator 151, and returned into the third rectification column 13.

The example shown here, a material flow k is drawn from the sump of the second rectification column 12 and transferred into a tank system 101. However, internal compression by means of a pump 7*c* subsequently takes place here. Furthermore, ultrahigh-purity oxygen in the form of a material flow k5 is drawn from the fifth rectification column 5. This material flow k5 is transferred to a tank system 102, temporarily stored there, evaporated in the main heat exchanger 1, and provided as an ultrahigh-purity oxygen product U1. Temporary storage of the argon product in a tank system 103 is also possible.

With regard to further details, reference is explicitly made to the explanations relating to the preceding figures, in particular to FIGS. 5 and 7. The features deviating from the preceding figures can also be implemented individually or together here.

FIGS. 9 to 28 illustrate a number of further variants of air separation units according to embodiments of the invention and according to non-inventive embodiments. Although other designations are used for certain material flows and apparatuses in some cases than in the preceding figures, they may also correspond to one another.

Figure 9:
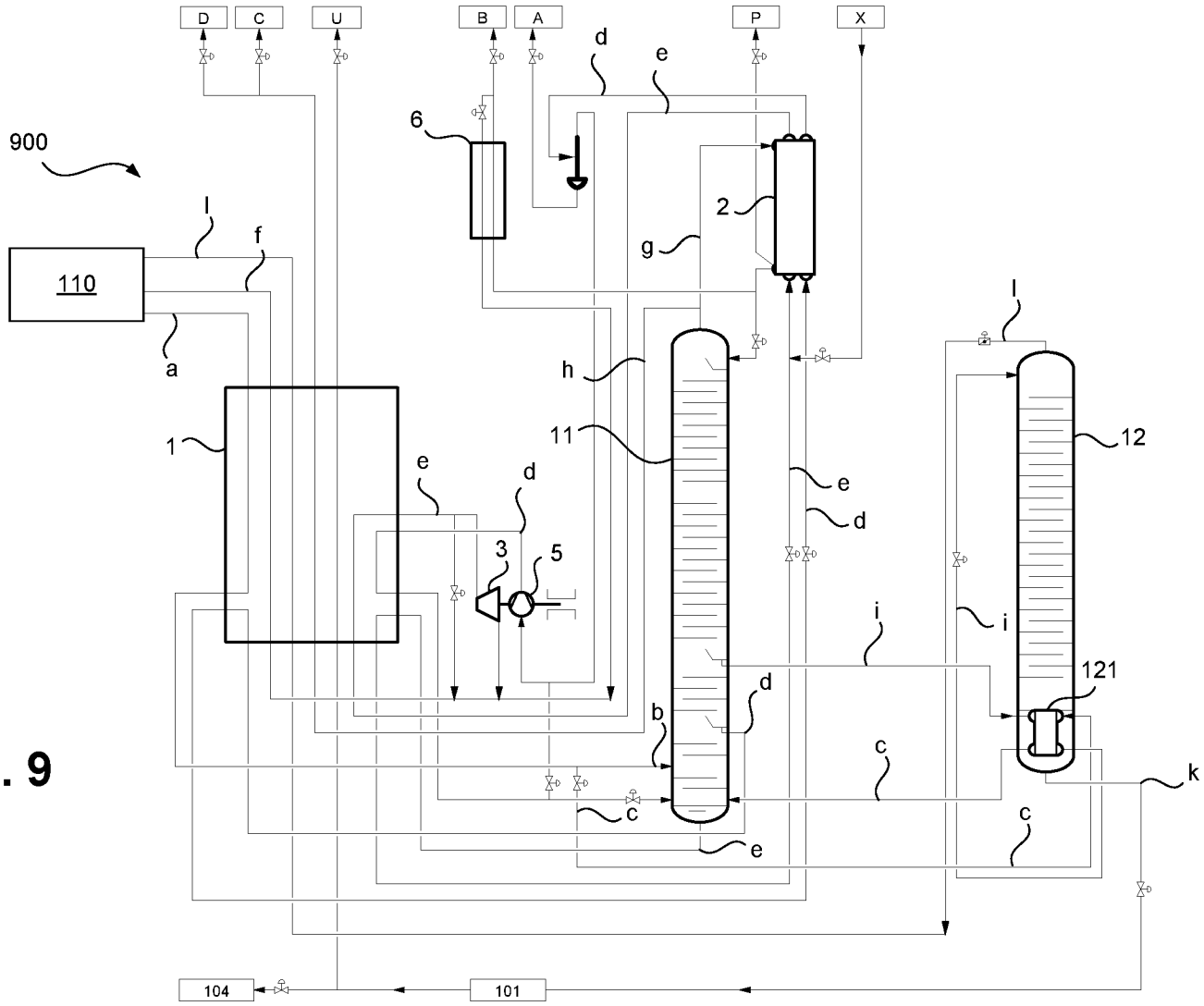

FIG. 9 illustrates, only as a basis for the explanations relating to the following figures, a non-inventive air separation unit with an oxygen column next to the first rectification column 11, i.e., a second rectification column 12, but without additional rectification columns, and designated overall by 900. The predominant fraction of the components illustrated in FIG. 9 has already been explained several times. As illustrated in FIG. 9, another storage tank 104 may be used, and the material flow l may be conducted separately through the main heat exchanger 1.

Figure 10:
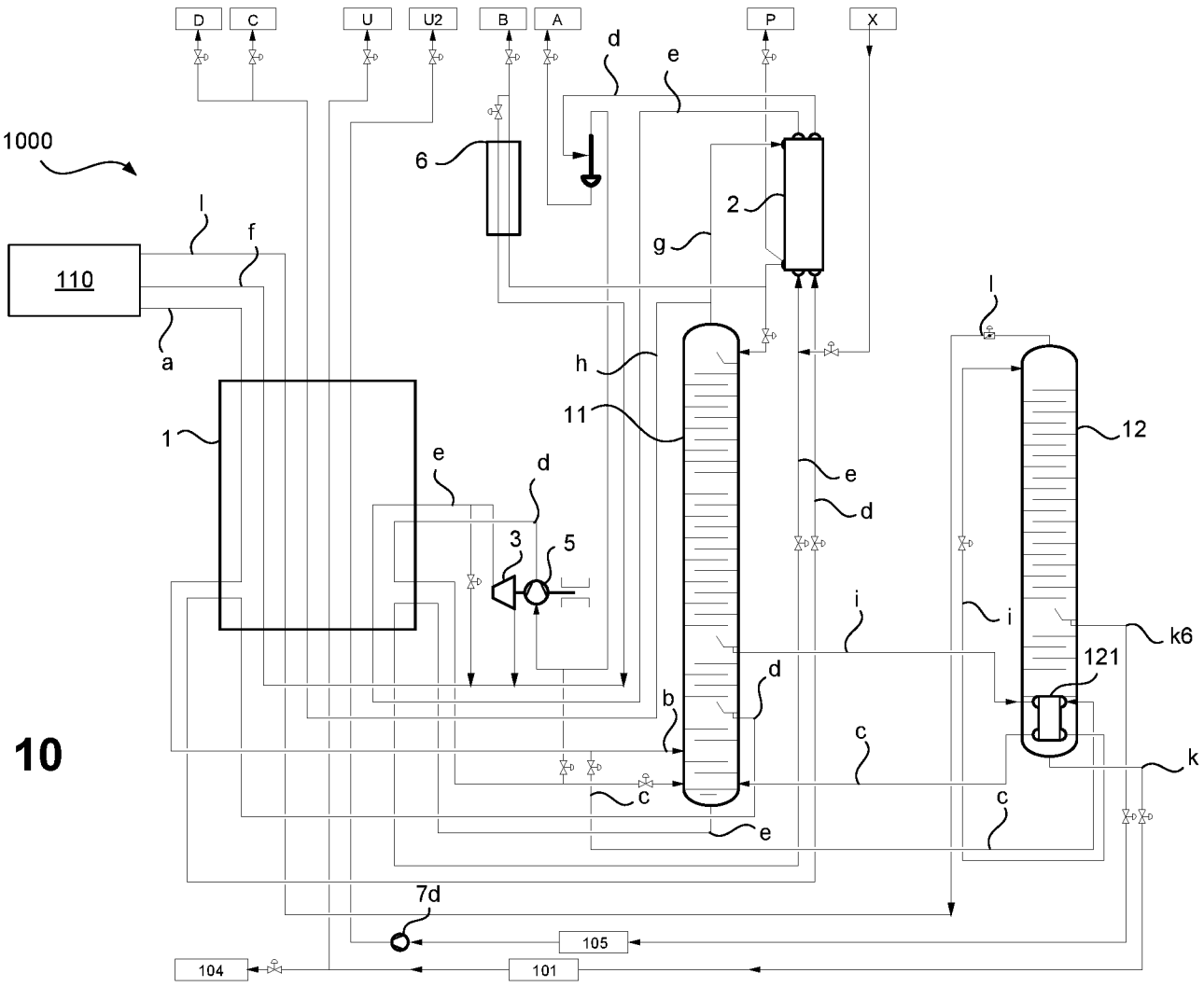

In FIG. 10, an air separation unit is illustrated and designated by 1000, which represents likewise non-inventive variant of the air separation unit 900 according to FIG. 9 and in which a material flow k6 is drawn from the second rectification column 12 via an intermediate extraction and is optionally, after temporary storage in a buffer tank 105 and internal compression in an internal compression pump 7*d* and heating in the main heat exchanger 1, discharged as a corresponding oxygen product U2.

Figure 11:
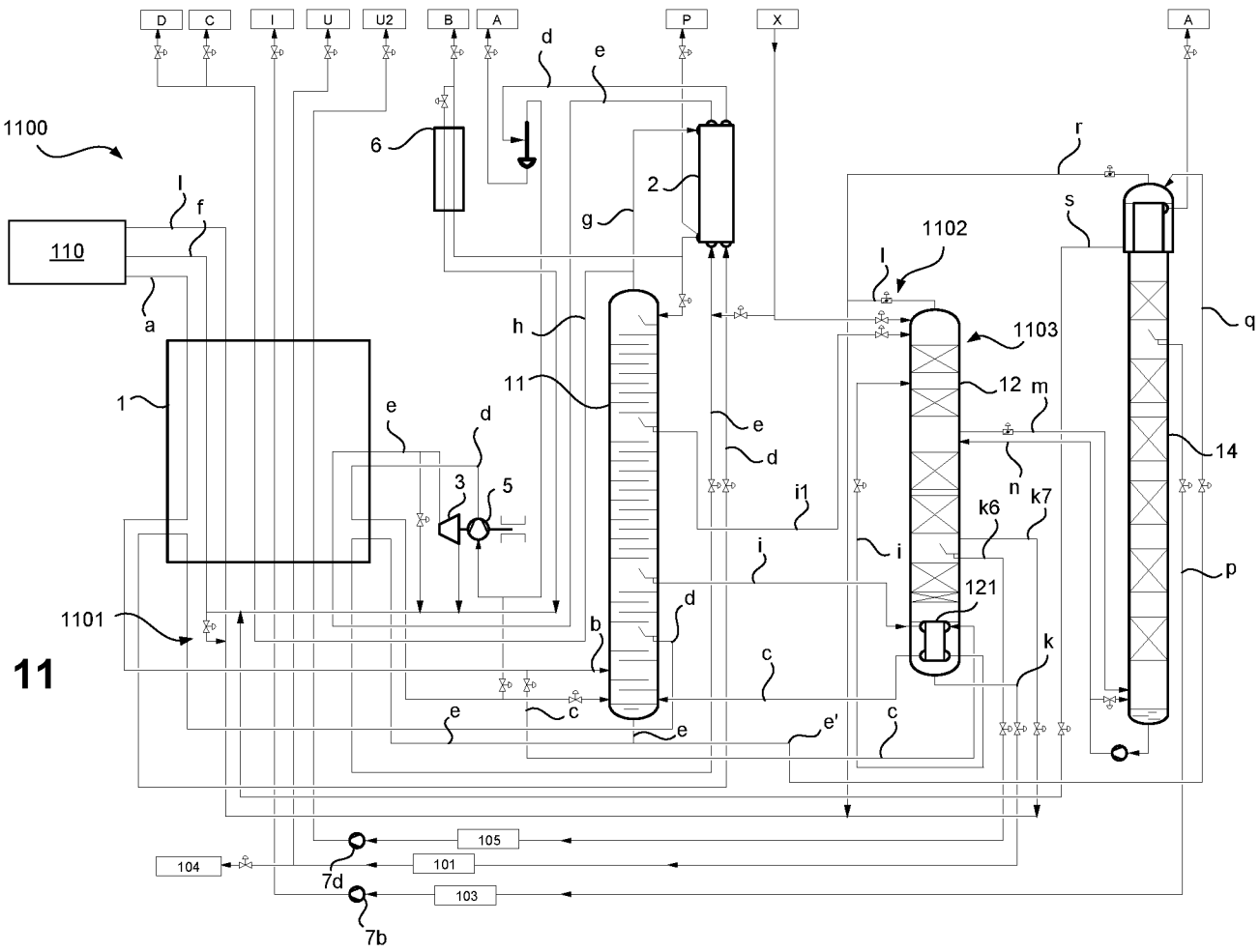

FIG. 11 illustrates another non-inventive air separation unit and is designated by 1100, which represents another variant of the units 900 and 1000 according to FIGS. 9 and 10. The air separation unit 1100 comprises a fourth rectification column 14 from which the material flow p, explained several times, is drawn in liquid form. Corresponding argon can be temporarily stored in a buffer tank 103 and, after internal compression in an internal compression pump 7*b* and heating in the main heat exchanger 1, can be discharged as a corresponding argon product l.

As illustrated here with 1101, a cross-connection between the material flows f and l may be provided on the cold side of the main heat exchanger 1. This cross-connection can be activated, in particular, in the case of a failure of one or more rectification columns in order to not have to shut down the air separation unit 1100 altogether in this way.

In this embodiment, as illustrated by 1102, liquid nitrogen provided externally and a liquid, nitrogen-rich material flow i1 from the first rectification column can also be supplied in this embodiment at the head of the second rectification column 12. Said material flow i1 has a lower nitrogen content than the head gas of the second rectification column 12. An additional separating section in the second rectification column 12 is designated by 1103.

A material flow k7 is drawn from the second rectification column 12, combined with the material flow l, and discharged or supplied to the warm part 110 in the form of this material flow, further designated by l for the sake of simplicity. In this way, the yield of gaseous, internally compressed argon (material flow p or product l) can be increased overall. The material flow l is fed to the material flow r, whereas the material flow s is used to form the material flow f.

Figure 12:
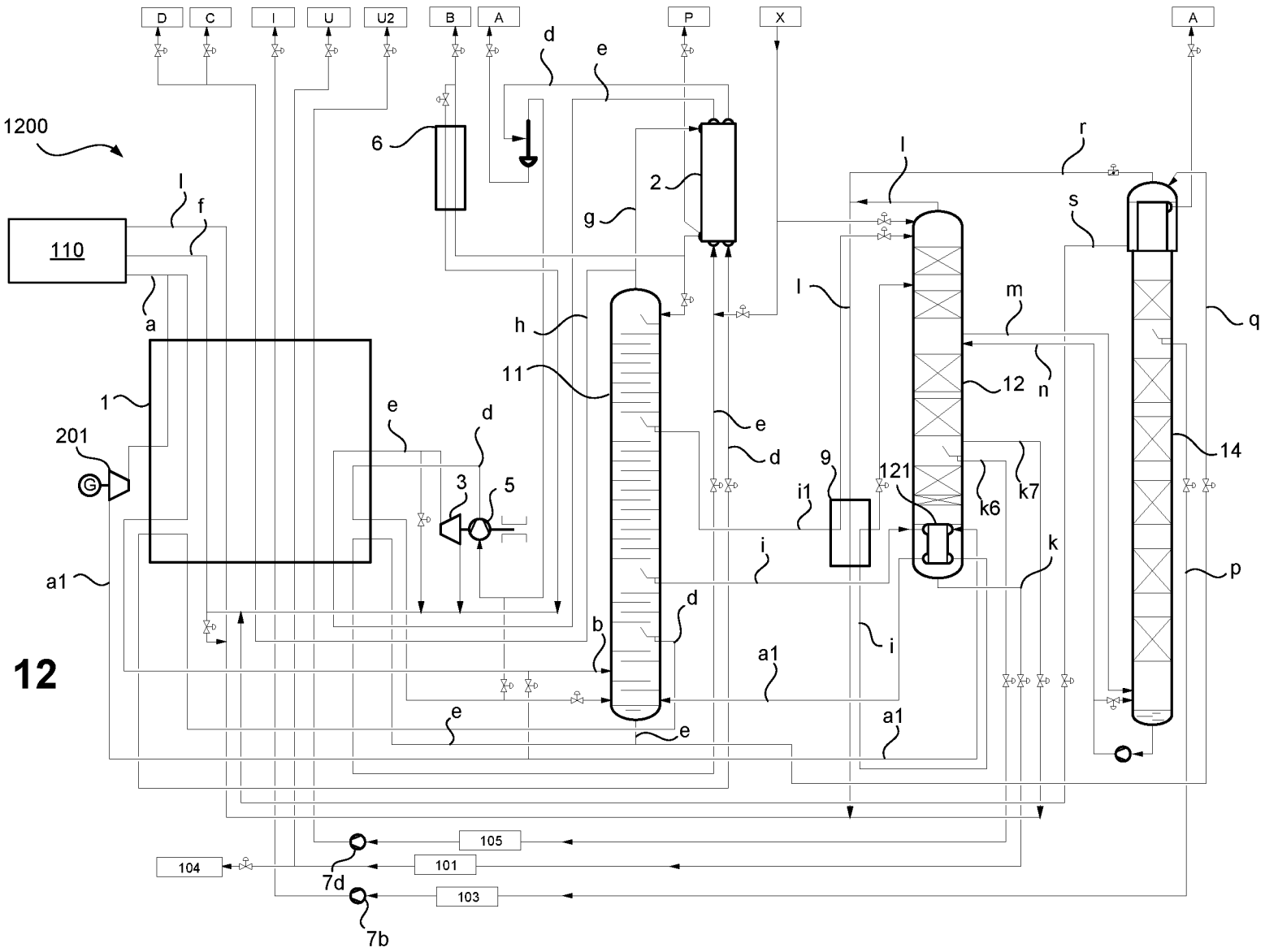

In FIG. 12, another non-inventive air separation unit is illustrated and designated by 1200, which in particular represents a variant of the air separation unit 1100 according to FIG. 11. The air separation unit 1200 comprises the additional expansion machine 201. The partial flow a1 is expanded in this additional expansion machine 201 and used as explained several times.

The remainder of the material flow a not expanded in the expansion machine 201 is treated comparably to the material flow comparably to the material flow b explained above and is therefore correspondingly designated. Furthermore, a subcooler 9 already explained several times is shown here. The second rectification column 12 is arranged with its lowest point in particular more than 6 m above the lowest point of the first rectification column 11.

Figure 13:
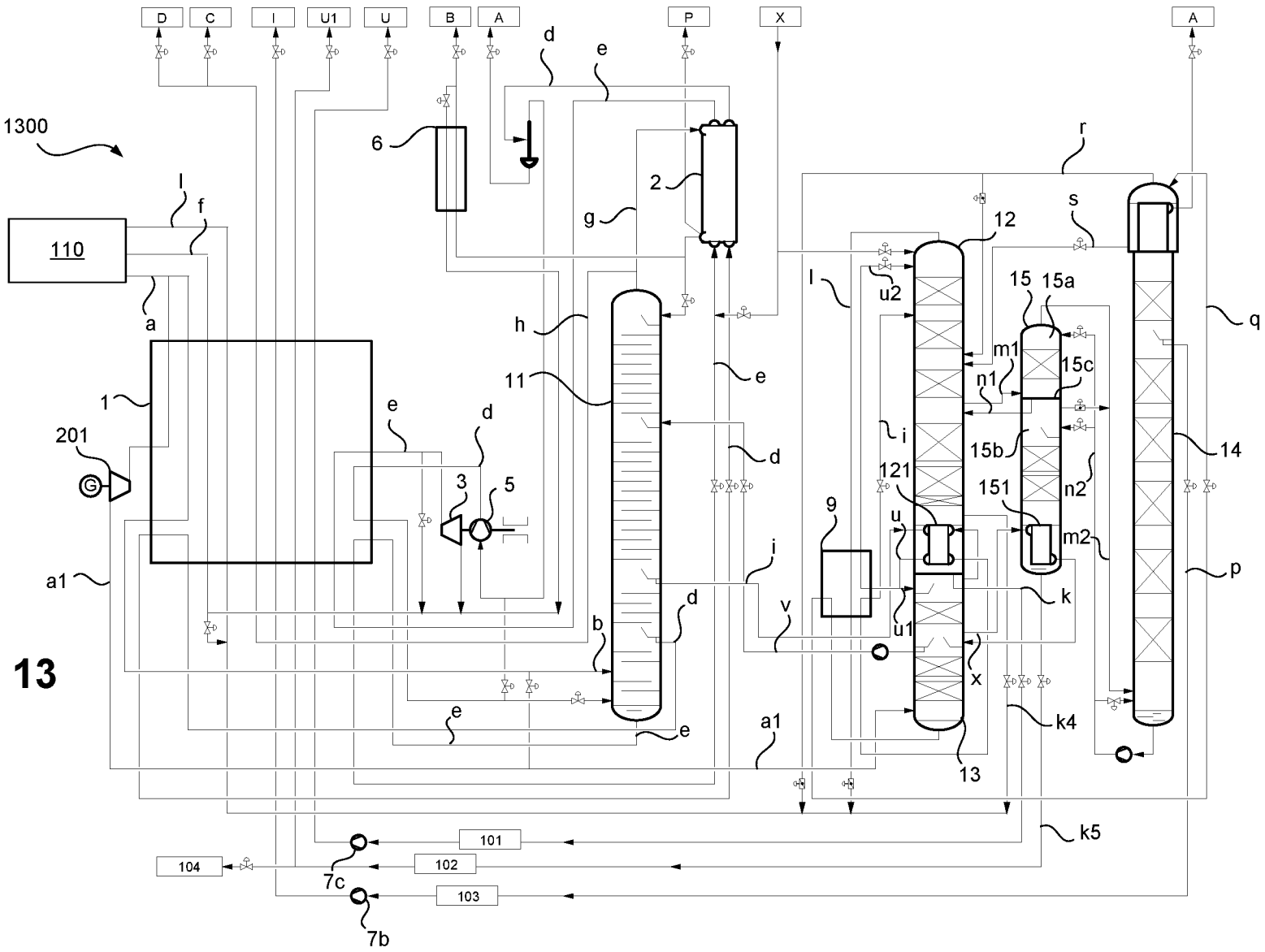

In FIG. 13, an air separation unit is illustrated and designated by 1300, which in particular represents a variant of the air separation unit 1200 according to FIG. 12 but in contrast thereto represents an embodiment of the present invention.

The air separation unit 1200 has the third rectification column 13 explained several times and the fifth rectification column 15, which have already been explained in more detail with reference to FIG. 8. With respect to the unit 900, reference is therefore explicitly made to the statements regarding the air separation unit 800 according to FIG. 8.

In deviation from the air separation unit 800 according to FIG. 8, an external liquid nitrogen X is in particular fed into the second rectification column 12, and a partial flow of the material flow r is combined with the material flow l and the material flow k3. This is the case in particular because there is no need for the complete return flow in the second rectification column 12, or an optimum prevails in this respect. As illustrated, the material flow i is supercooled here in the condenser evaporator 121 before being fed into the second rectification column 12.

Figure 14:
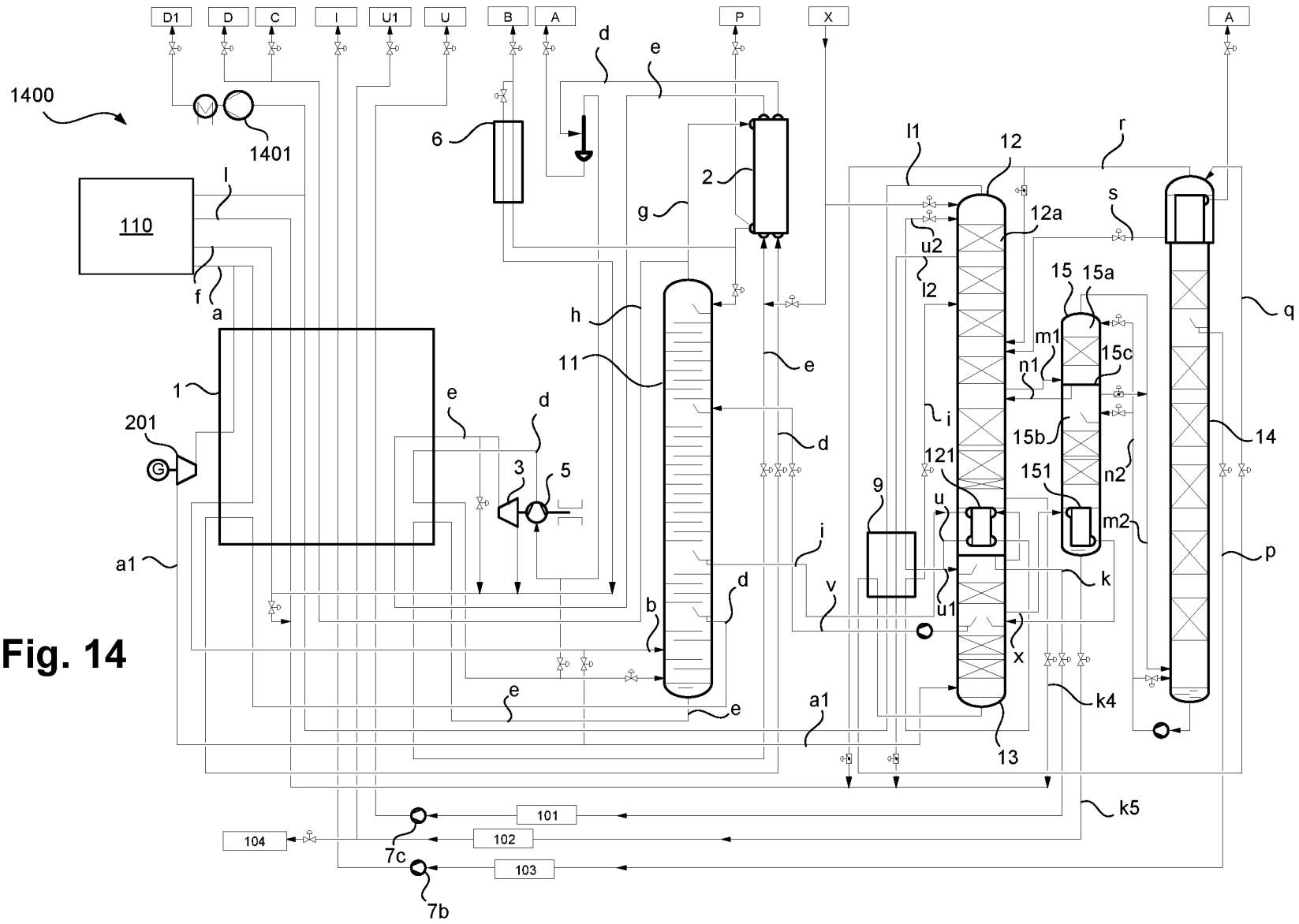

In FIG. 14, an air separation unit is illustrated and designated by 1400, which in particular represents a variant according to the invention of the air separation unit 1300 according to FIG. 13. The air separation unit 1400 is configured to provide another compressed nitrogen product D1.

For this purpose, the head flow of the second rectification column 12 is obtained with higher purity than before the material flow l. The latter is therefore designated by l1 here. This is achieved by withdrawing an additional material flow l2 from the second rectification column 12 below the head. Furthermore, the second rectification column is provided here with an additional separating section 12*a*. The illustrated embodiment also has a positive effect on the yield and purity of argon.

The material flows combined with the material flow l in the air separation unit 1300 according to FIG. 13 are now combined with the material flow l2 into a material flow designated again by l for the sake of simplicity. The material flow l1 is partially compressed in an external compressor 1401 after being heating in the main heat exchanger 1. Another portion passes into the warm part 110. Further details in this respect are also illustrated in more detail in FIGS. 27 and 28.

Figure 15:
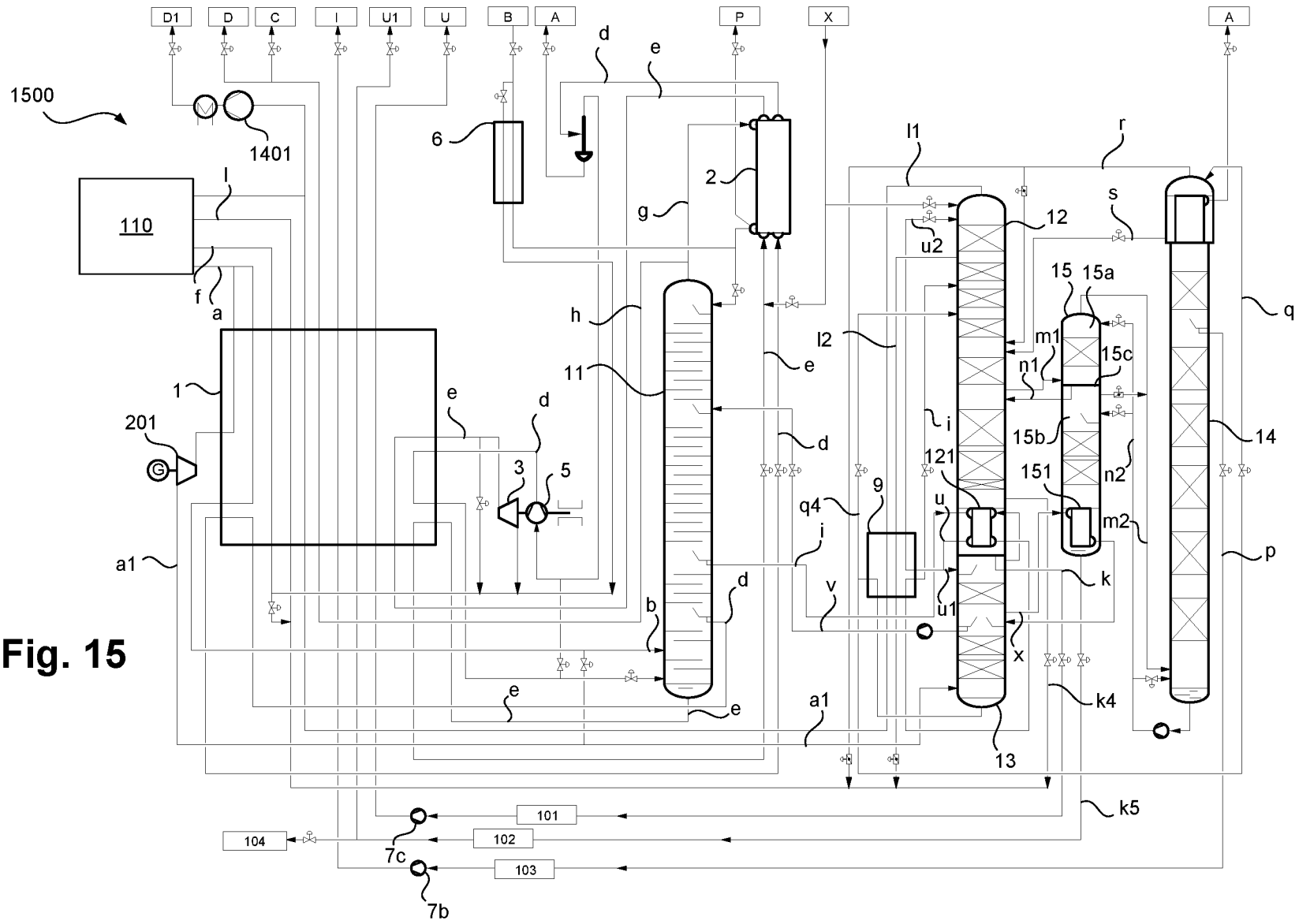

In FIG. 15, an air separation unit is illustrated and designated by 1500 as a whole, which in particular represents a variant according to the invention of the air separation unit 1400 according to FIG. 14.

The sump liquid of the third rectification column 13 which is used in the air separation unit 1400 according to FIG. 14 only to form the material flow q is partially used here to form a material flow q4 (see also the air separation unit 800 according to FIG. 8 in this respect) which is supplied to the second rectification column 12. The second rectification column 12 and the feed point of the material flow i are adapted accordingly.

Figure 16:
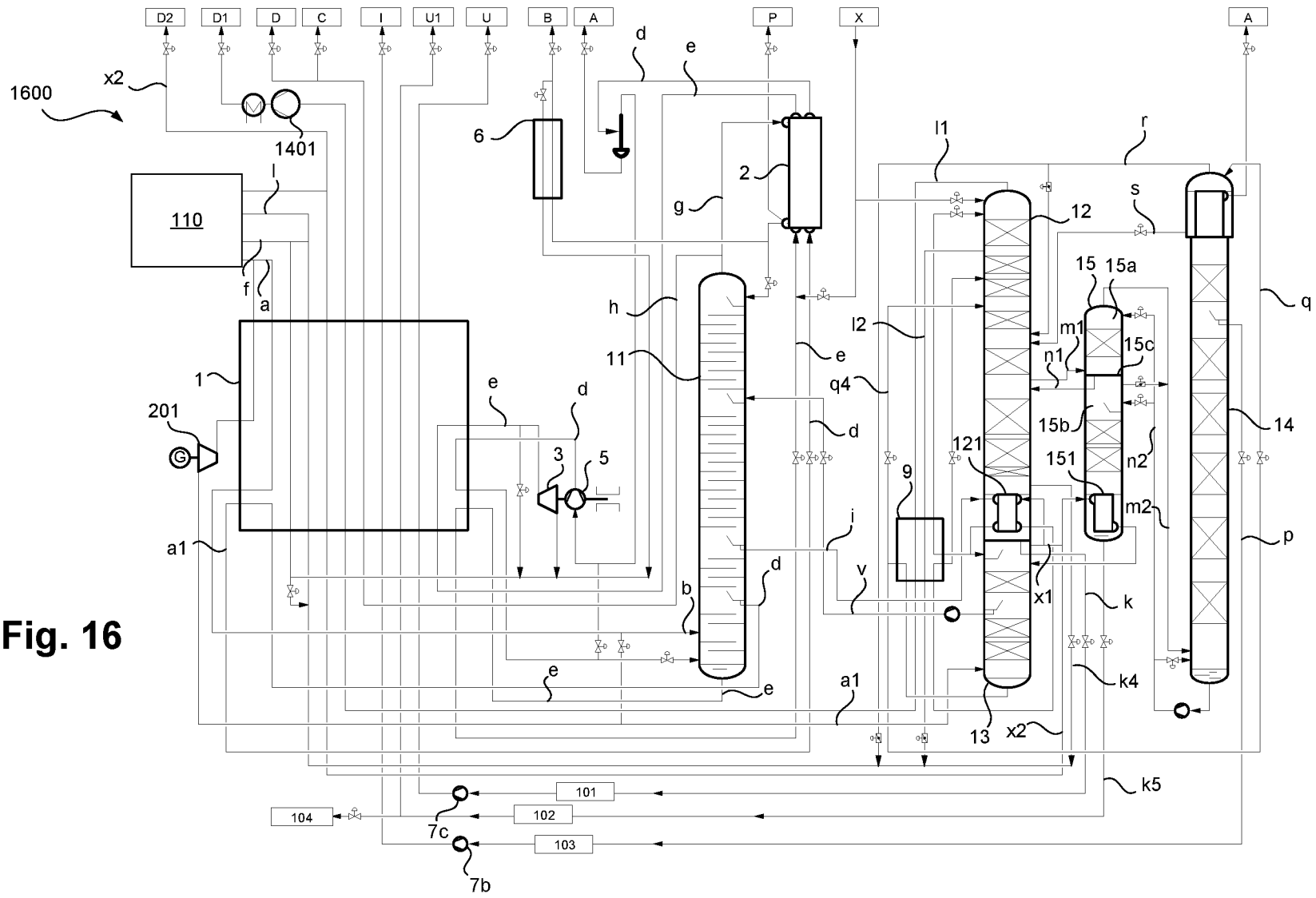

In FIG. 16, an air separation unit is illustrated and designated by 1600, which in particular represents a variant according to the invention of the air separation unit 1500 according to FIG. 15.

The material flow x formed in the previously explained units 800 and 1300 to 1500 is not correspondingly used here. Instead, a material flow x1 is branched off as partial flow of the head gas drawn from the third rectification column 13 and, as previously the material flow x, is in part liquefied in the condenser evaporator 151 and returned to the third rectification column 13 as a return flow. Another portion is heated in the form of a material flow x2 and is at least in part discharged as an additional nitrogen product D2 from the air separation unit 1600.

Figure 17:
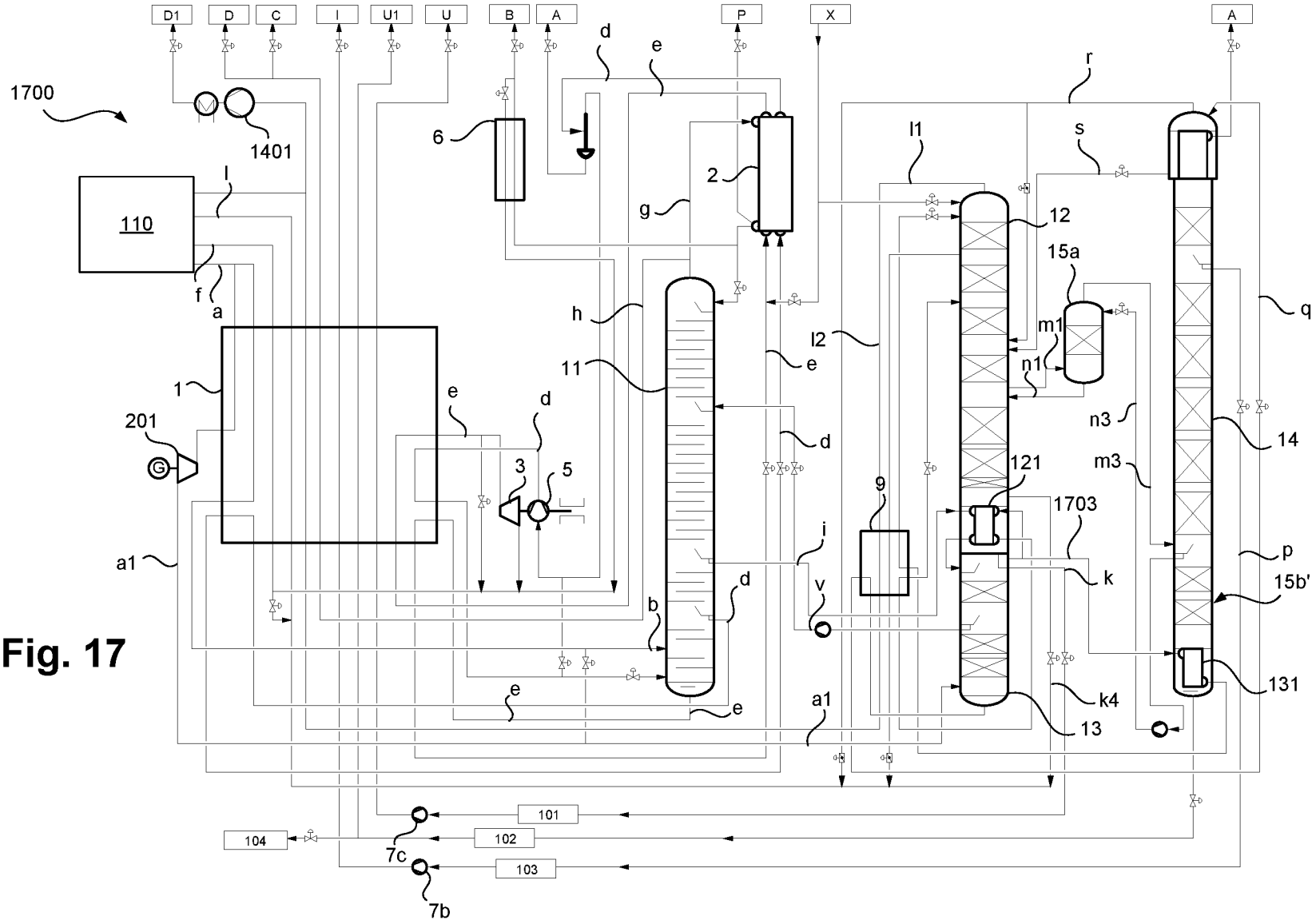

In FIG. 17, an air separation unit is illustrated and designated by 1700, which in particular represents a variant according to the invention of the units according to the previous figures in which a fifth rectification column 15 is used. However, said fifth rectification column 15 is present here in modified form and is designated by 15*a* as before.

The rectification column 15*a* corresponds to the upper part 15*a* of the fifth rectification column 15 of the previous figures. From its head, a material flow m3 is transferred into the fourth rectification column 14 and is fed into a region above the sump which functionally corresponds to the lower part 15*b* of the fifth rectification column 15 of the previous figures and which is therefore designated by 15*b*' here. Liquid accumulating here is pumped back to the rectification column 15*a* in the form of a material flow n3 by means of a pump not designated separately. By means of the embodiment according to FIG. 17, it is possible in particular to achieve the absence of non-ferrous metals in the oxygen product U because, as a result of this arrangement, the fluid which is conducted to the partial column 15*b*' does not come into contact with an impeller of a pump which usually consists of bronze.

Figure 19:
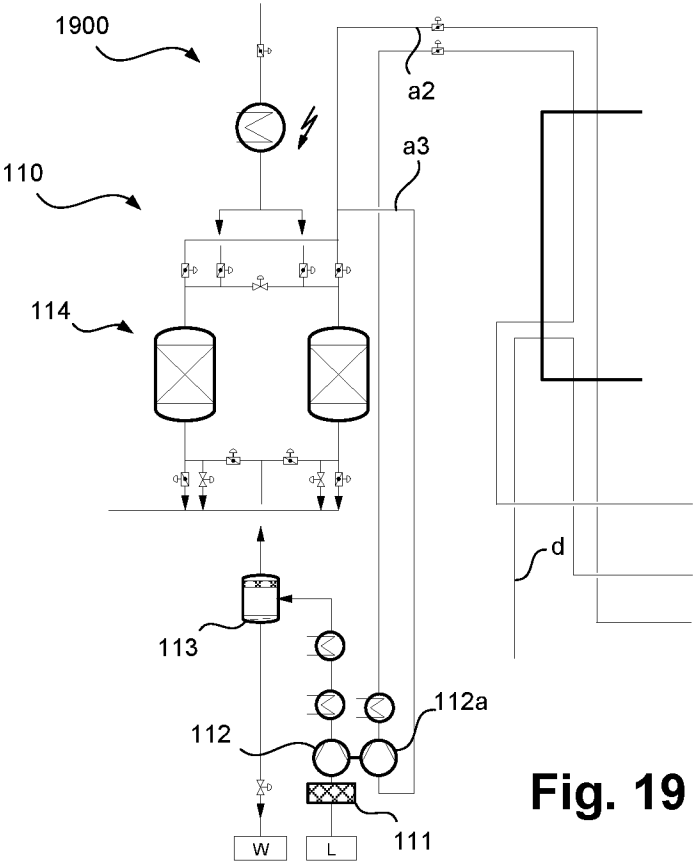
Figure 18:
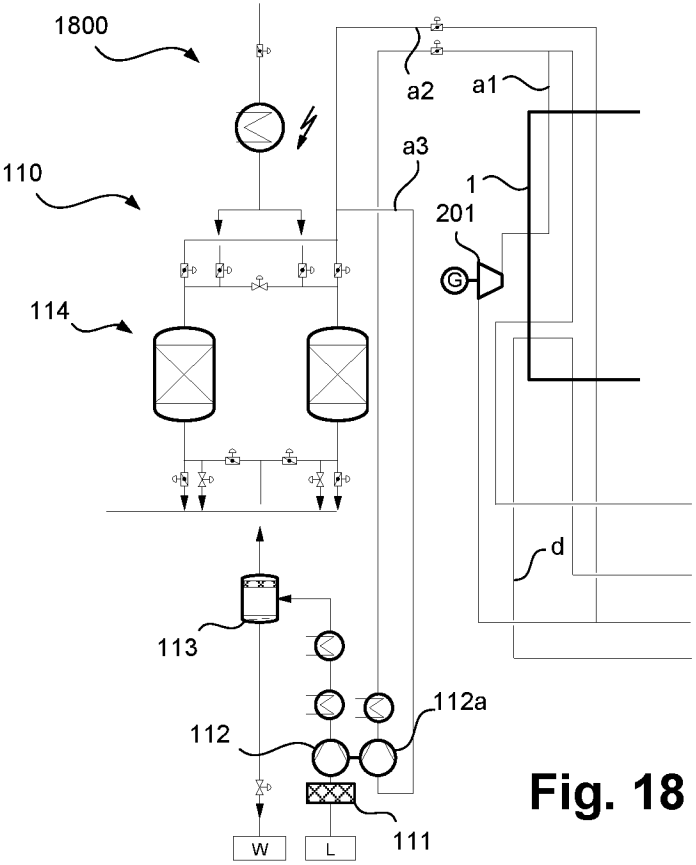

In FIGS. 18 and 19, variants of units are illustrated and designated by 1800 and 1900, in which the warm part 110 and the routing of the material flows are substantially modified by the main heat exchanger 1. Only this warm part 110 and a section of the main heat exchanger 1 as well as material flows required for understanding this variant are shown in FIGS. 18 and 19.

According to FIG. 18, the cooled and purified air compressed in the main air compressor 112 is divided into partial flows a2 and a3, of which the partial flow a2 is conducted through the main heat exchanger 1 from the warm end to the cold end. By contrast, the material flow a3 is further compressed by means of a compressor or a compressor stage 112*a*, which is coupled to the main air compressor 112, and is then treated like the material flow a of the previous figures. In particular, a partial flow, designated by a1 here as before, is expanded in the expansion machine 201 and then combined with the material flow a2. As illustrated in the variant according to FIG. 19, an expansion machine 201 and the formation of the material flow a1 can also be dispensed with.

By using the measures illustrated in FIGS. 18 and 19, energy consumption can be reduced since not all of the air but only the fraction of the material flow a3 needs to be brought to a high pressure.

Figure 20:
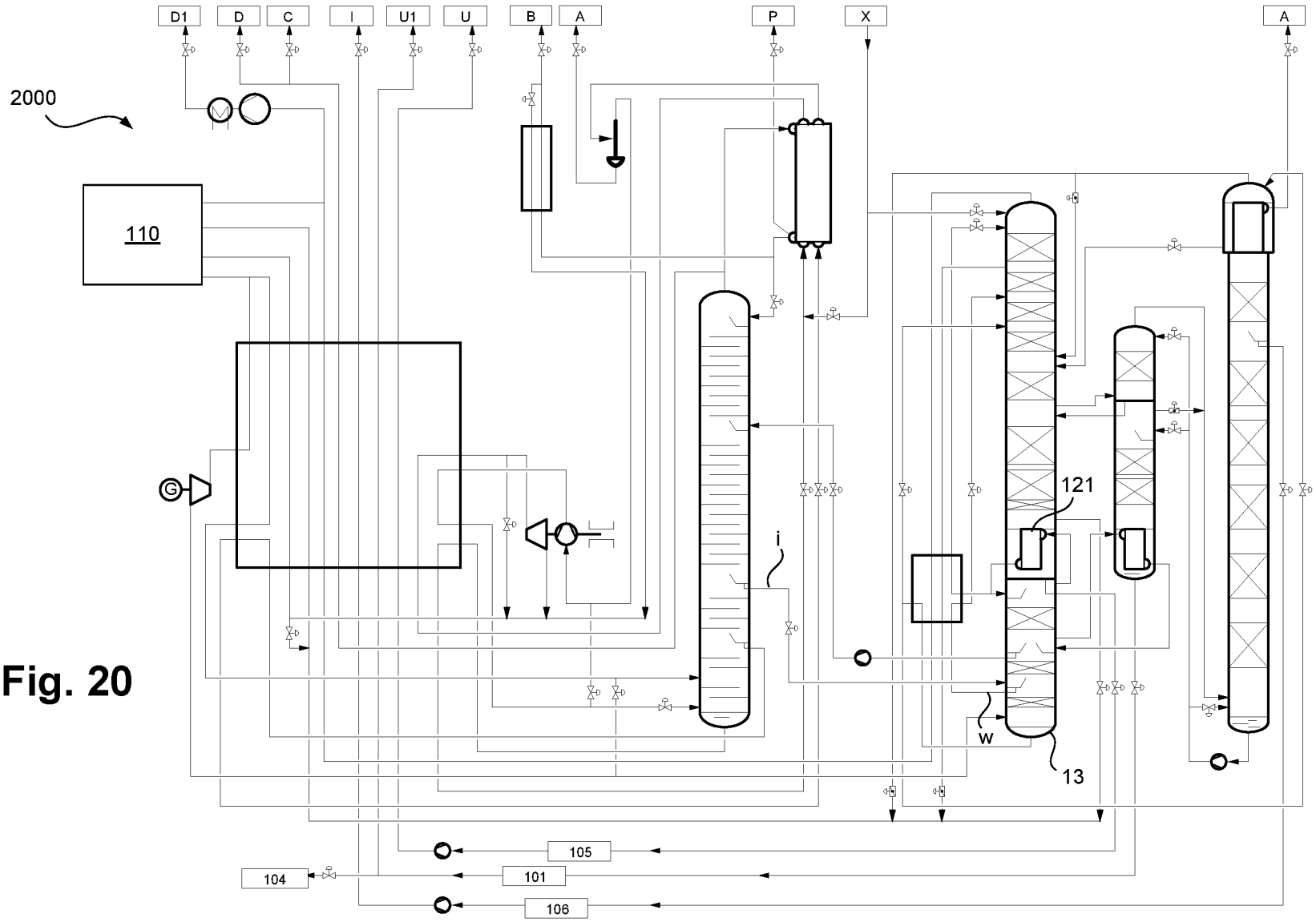

In FIG. 20, a variant of an air separation unit according to the invention is illustrated and designated by 2000, which has commonalities with the air separation unit 800 according to FIG. 8 and other units described above, in particular with regard to the treatment of the material flows i and w. As a result, the third rectification column 13 can be used to separate the material flow i, and a higher fraction of nitrogen product can be obtained. Reference is made to the above explanations, and only a few material flows are individually designated here and below.

The embodiment according to FIG. 20 (and according to FIG. 8) has the particular advantage that the condenser evaporator 121 can be simplified, and a likewise simplified regulation can be used. The material flow w can be regulated in particular like a conventional Joule-Thomson flow.

Figure 21:
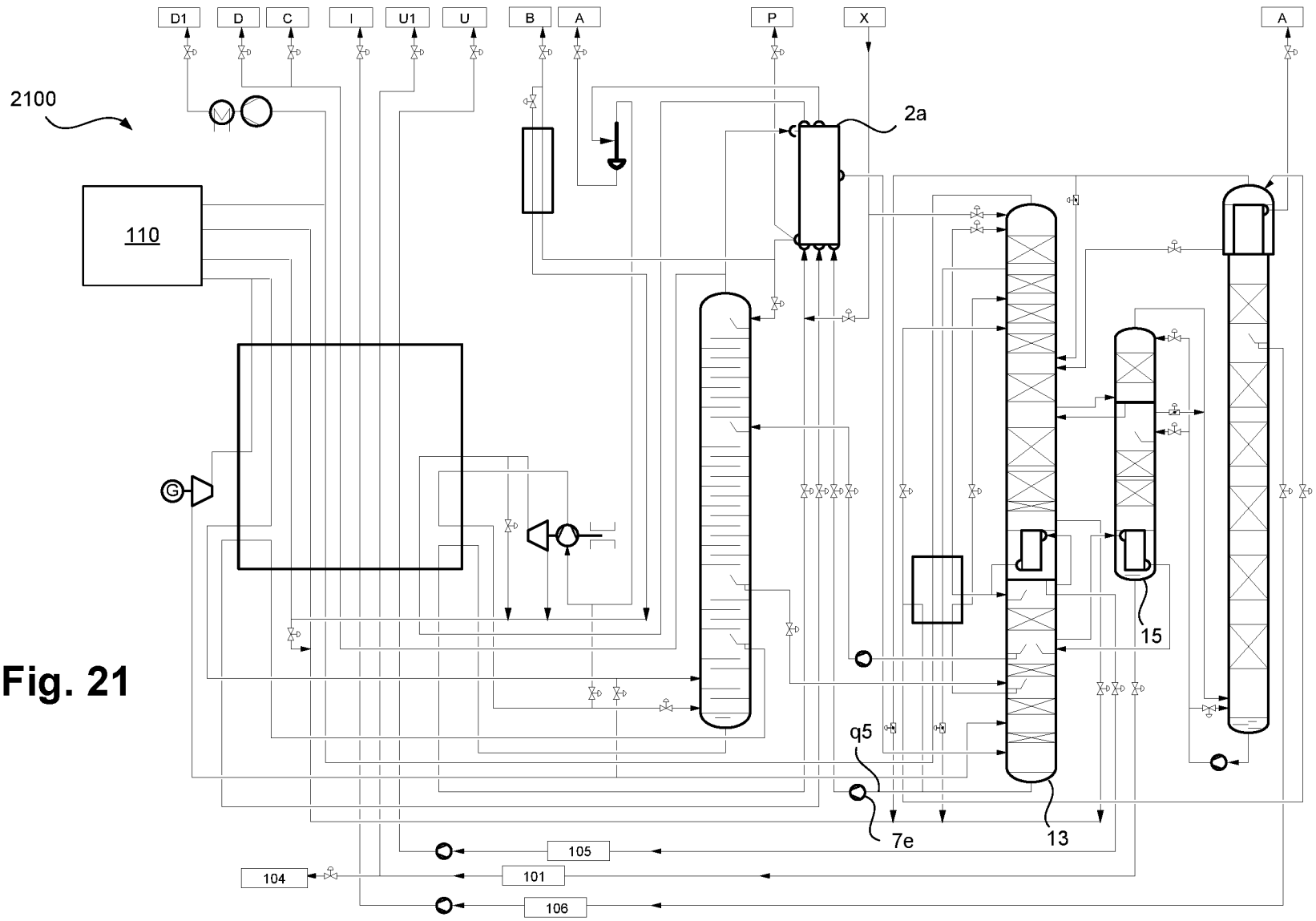

In a variant thereof according to the invention, which is illustrated in FIG. 21 and designated by 2100, a material flow q5 is formed using sump liquid from the fourth rectification column 14, is conducted by means of a pump 7*e* through the modified heat exchanger 2, which is designated here by 2*a*, and is thereby cooled, and subsequently returned into the third rectification column 13. This makes it possible, in particular, to improve the extraction of nitrogen in the third rectification column 13, as a result of which higher constructions of all products are possible.

Figure 22:
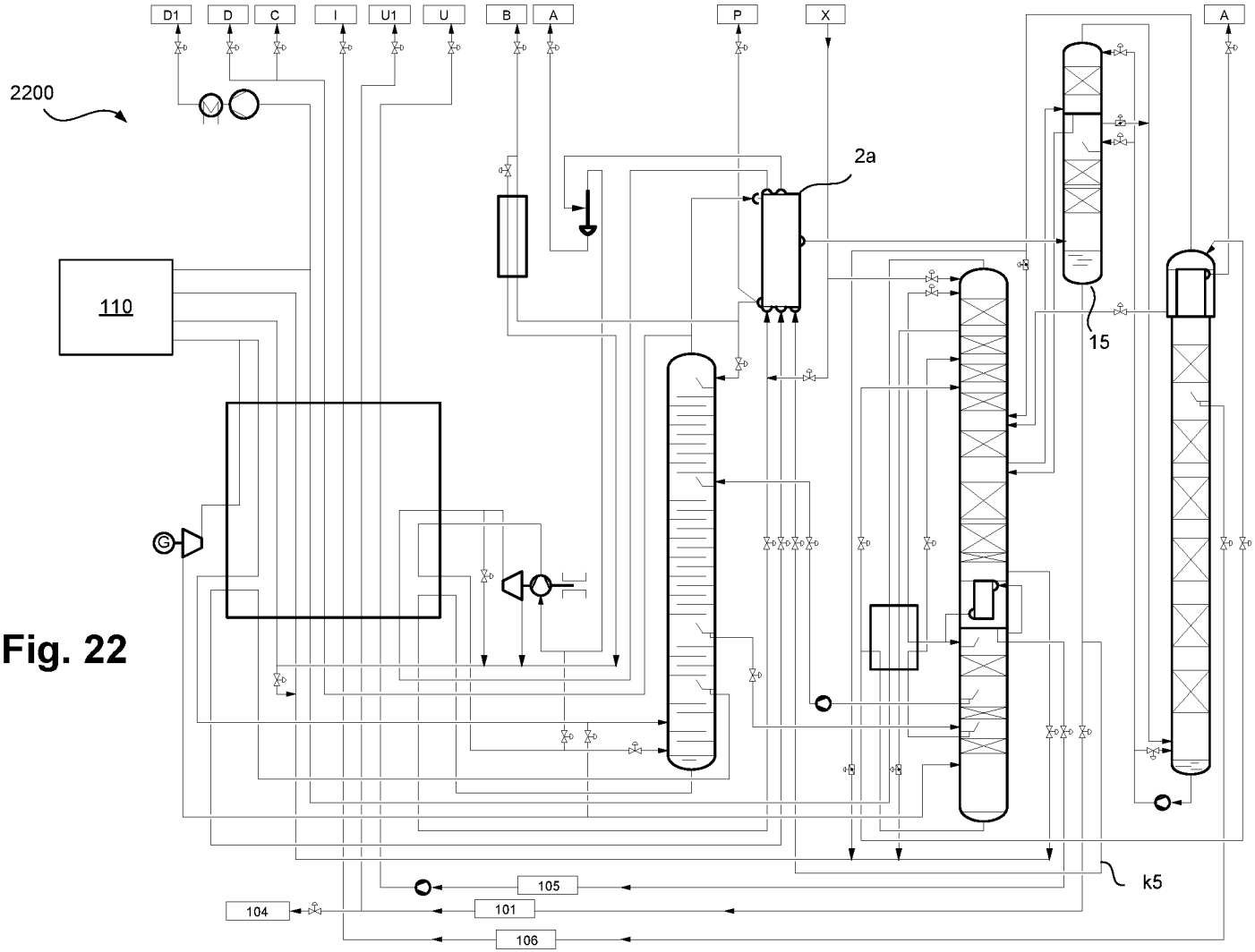

In another variant according to the invention, which is illustrated in FIG. 22 and designated by 2200, a material flow k5 formed by sump liquid from the fifth rectification column 15 is correspondingly treated and returned to the fifth rectification column 15.

Figure 23:
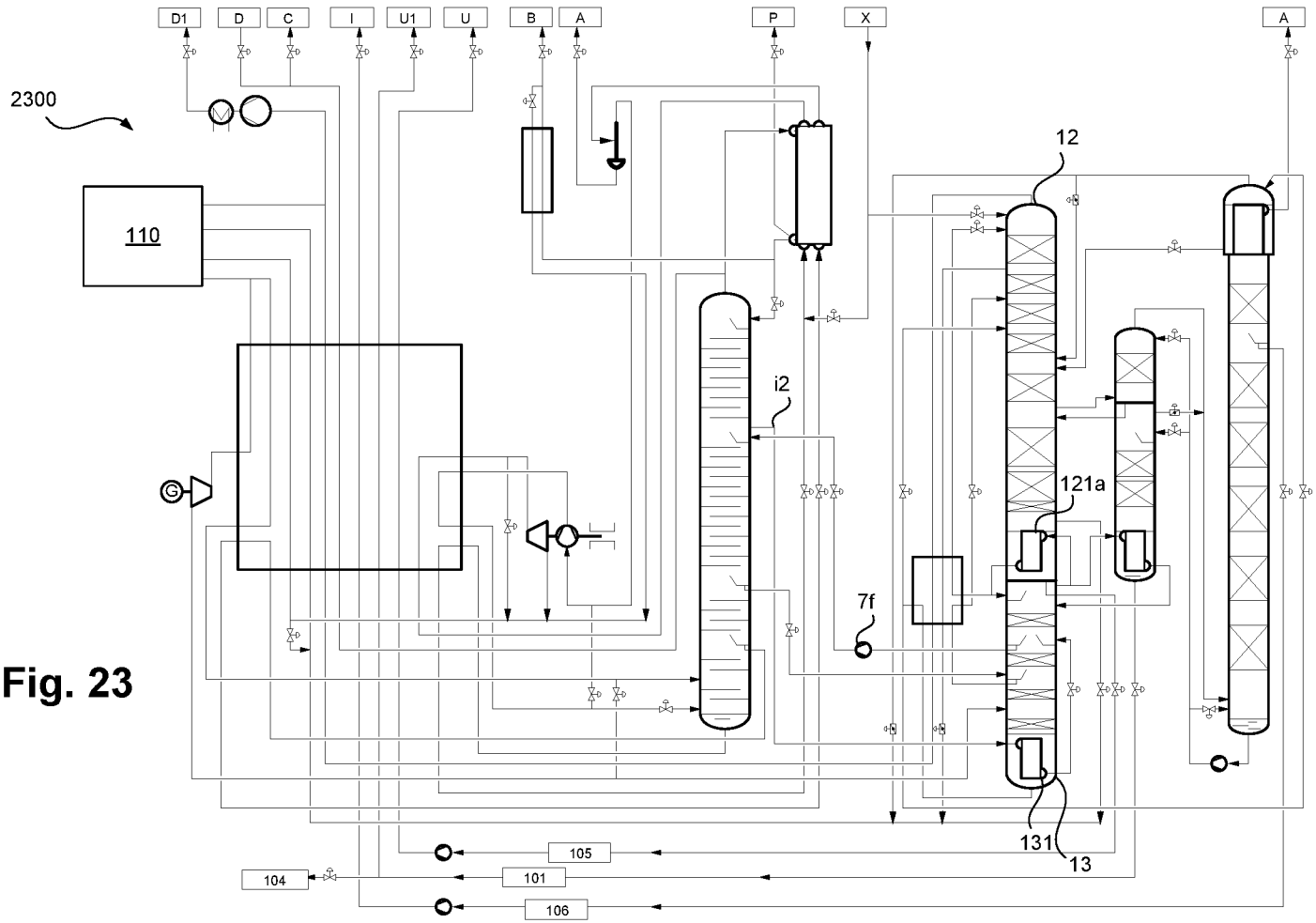

FIG. 23 illustrates an air separation unit according to another embodiment of the invention and is designated by 2300. This air separation unit differs from the previously shown embodiments in particular by a condenser evaporator 131 arranged in the sump of the third rectification column 13. This can be considered functionally as a division of the condenser evaporator in the second rectification column 12, which is designated here by 121*a*. In this way, the extraction of nitrogen in the second rectification column 12 or the third rectification column 13 can be improved.

As shown here, fluid in the form of a material flow i2 can be drawn from the second rectification column 2 via a side offtake, conducted through the condenser evaporator 141, thereby at least partially liquefied, and fed into the third rectification column 13. At the same height, liquid can be drawn from the third rectification column 13 and returned into the second rectification column 12 by means of a pump 7*r*.

Figure 24:
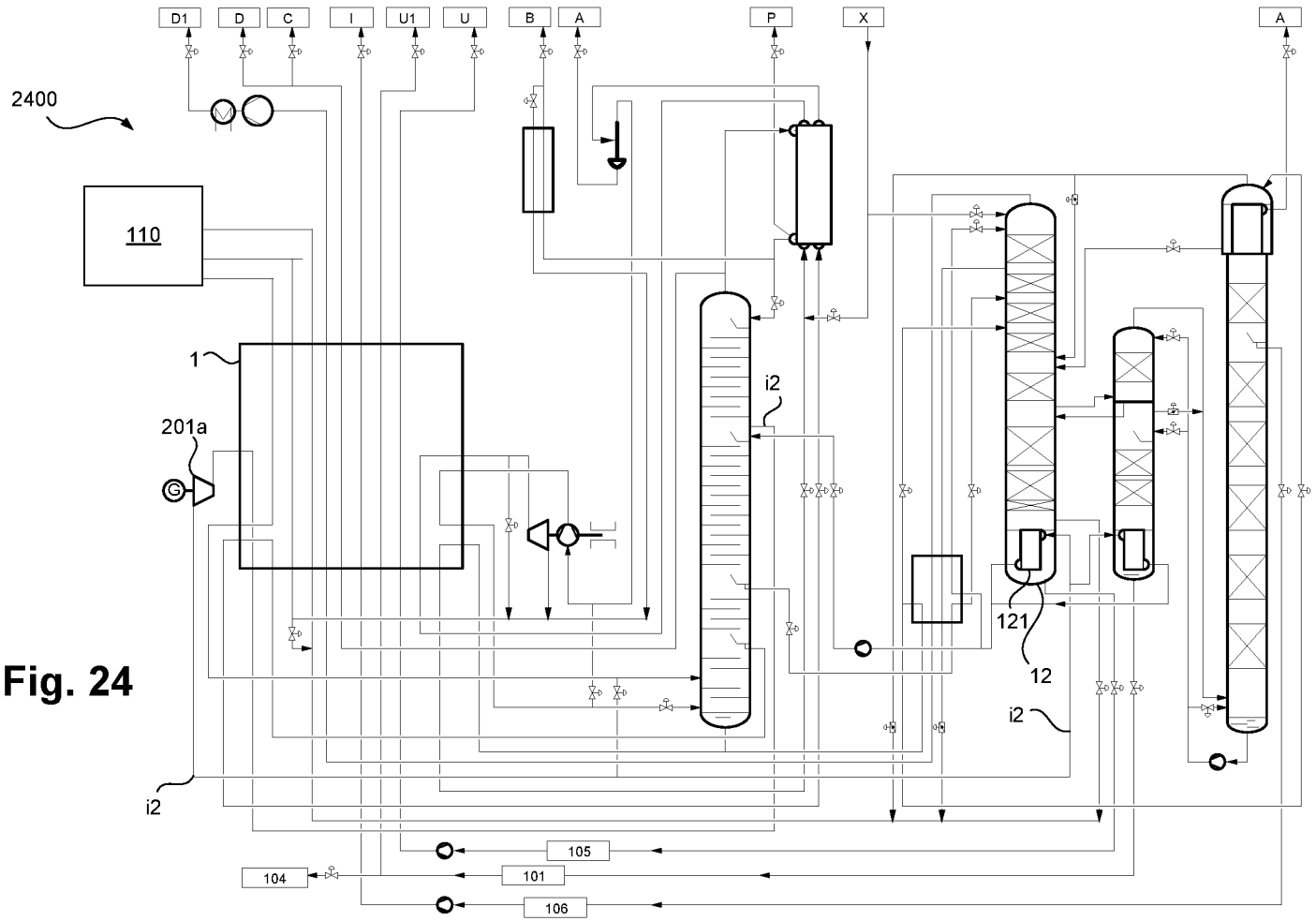

A non-inventive variant is shown in FIG. 24 on the basis of the unit designated by 2400, which lacks the third rectification column 13 or in which the function thereof is integrated into the first rectification column 11. The material flow i2 is partially heated here in the main heat exchanger 1, expanded in an expansion machine 201*a*, cooled again in the main heat exchanger 1, and a fraction thereof is conducted through the condenser evaporator 121 of the second rectification column, thereby at least partially liquefied, and fractions thereof are in turn supplied to the first and second rectification columns 11, 12. The expansion machine 201*a* is coupled to a generator, for example.

Figure 25:
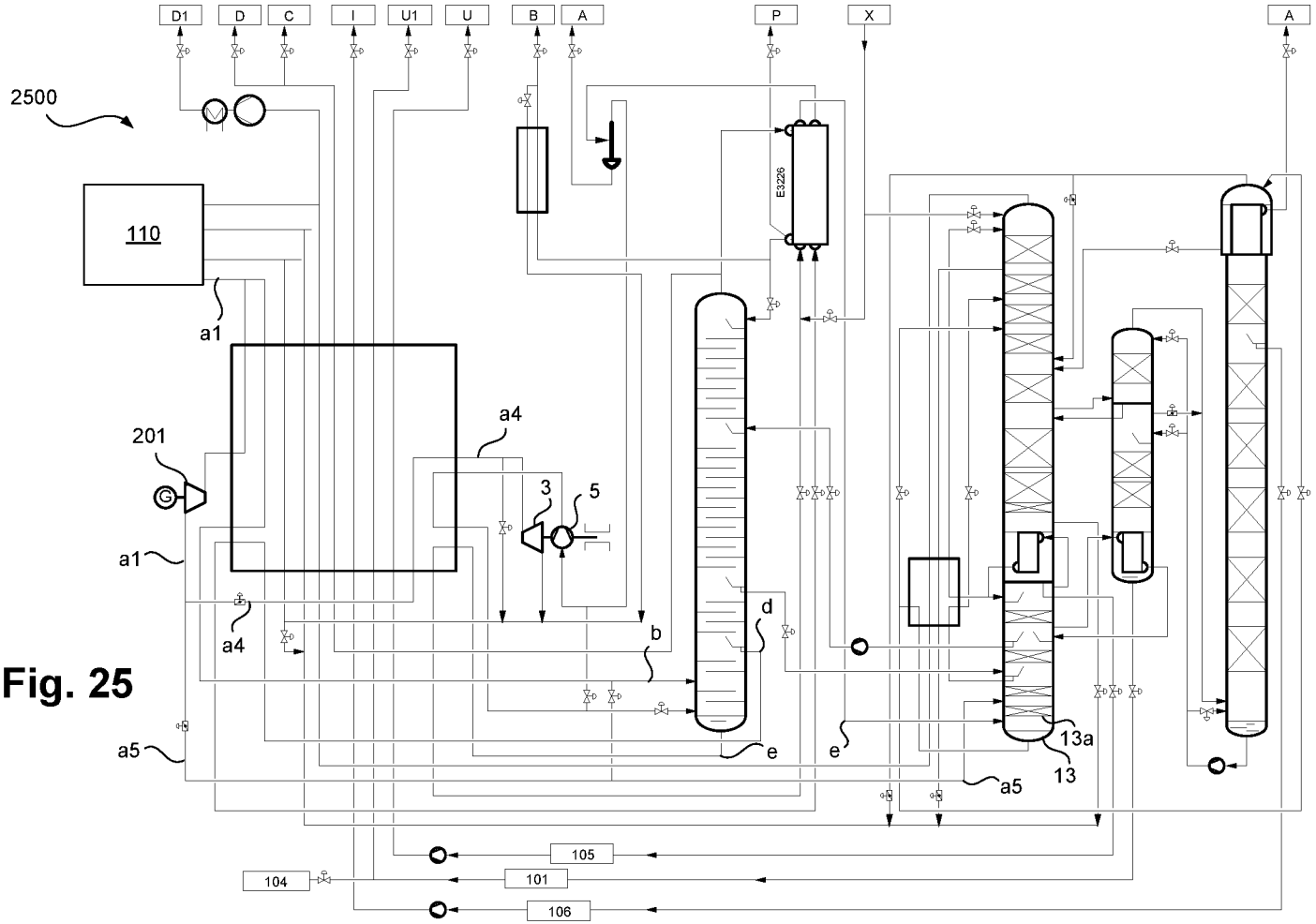

In FIG. 25, an air separation unit again according to the invention in accordance with another embodiment of the present invention is illustrated and designated by 2500 as a whole. This air separation unit differs from the previous units, in which a material flow a1 is formed and expanded, by the further treatment of this material flow a1.

In the air separation unit 2500, the partial flow a1 is divided into partial flows a4 and a5, the fractions of which can each be adjusted via valves not designated separately. The partial flow a4 is expanded instead of the partial flow e, as was previously the case, in the expansion machine 3 and optionally the parallel expansion valve and is thus partially used for driving the compressor 5. As the entire partial flow a1 before, the partial flow a5 is fed, for example, into the third rectification column 13. The material flow e is nevertheless formed and partially treated as before, but not expanded by means of the expansion machine 3 and the expansion valve 4. It is fed into the third rectification column 13 below the material flow a5. In this case, the third rectification column 13 can be provided with an additional separating section 13*a*.

Rectification columns 11 to 15 can be thermally coupled by the measures illustrated in FIG. 25. Residual gas from the first rectification column 11 can be used for argon, oxygen, and nitrogen extraction. The flow e can be conducted entirely or partially to the second rectification column 12. The remainder can be discharged via the expansion machine 3 as a residual gas for use in the warm part 110.

Figure 26:
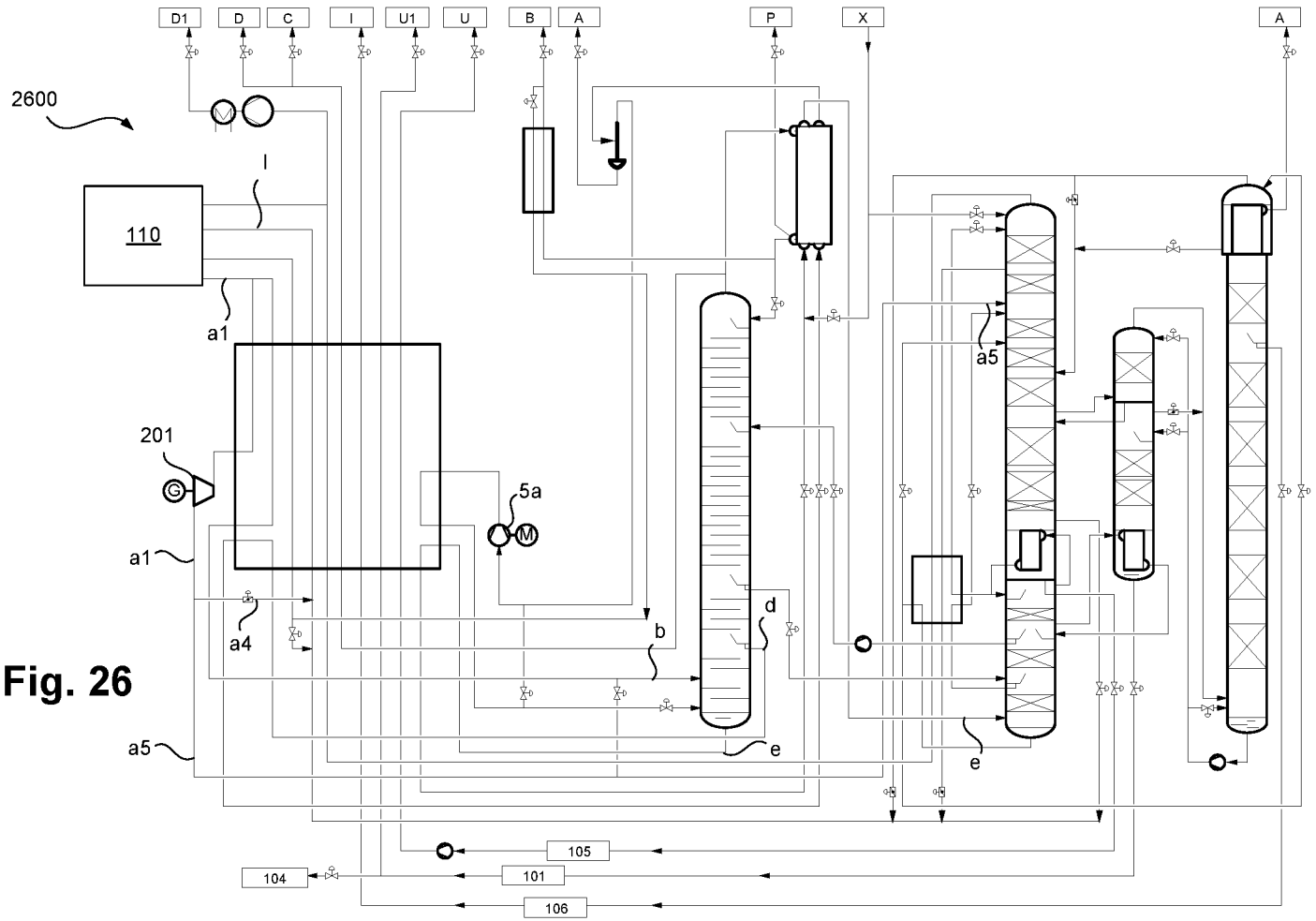

In FIG. 26, an air separation unit according to another embodiment of the present invention is illustrated and designated overall by 2600. This air separation unit represents in particular a variant of the air separation unit 2500. The partial flow a1 is also divided here into partial flows a4 and a5, wherein, however, the material flow a4 is fed here to the material flow l before the latter is heated and discharged or supplied to the warm part 110. The partial flow a5 is fed into the second rectification column 12. The function of the expansion turbine 201 therefore corresponds here to that of a Lachmann turbine. Rectification columns 11 to 15 can be thermally coupled by the measures illustrated.

The partial flow d is formed and compressed as before, wherein a compressor used for this purpose, which is therefore designated differently by 5*a*, is however driven here purely by motor. The partial flow e is fed into the fourth rectification column 14, as previously explained with reference to FIG. 25.

Figure 28:
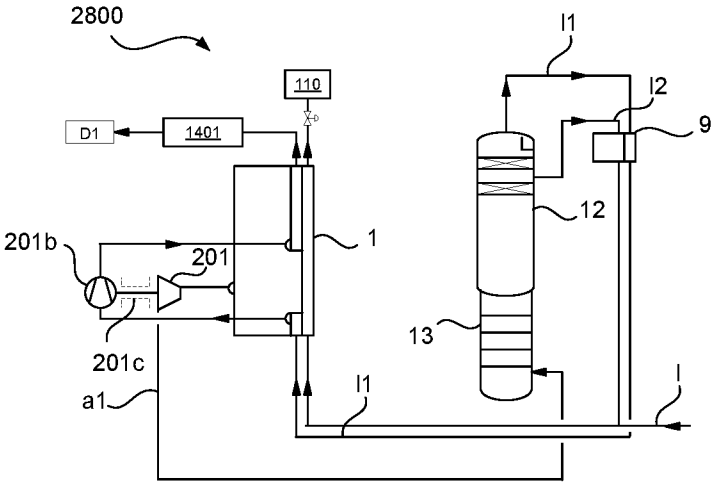
Figure 27:
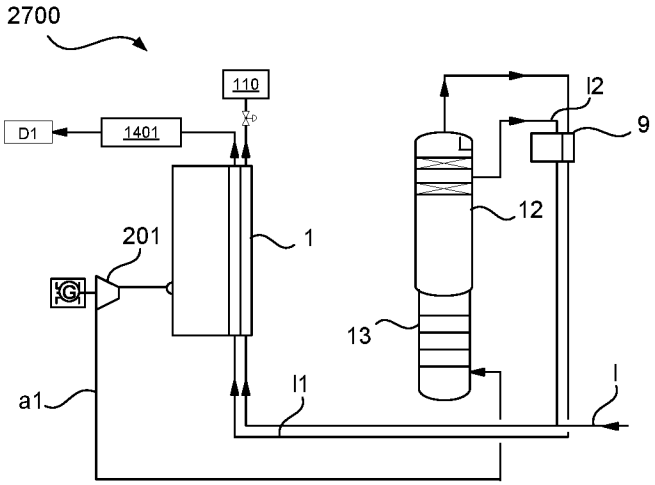

In the air separation units 2700 and 2800 according to embodiments of the invention illustrated in FIGS. 27 and 28 in a partial representation, the material flow l1 mentioned for the first time with reference to FIG. 14 is formed. Reference is explicitly made to the explanations in that regard. As illustrated in FIG. 28 on the basis of the air separation unit 2800, the material flow l1 can first be partially heated in the main heat exchanger 1, compressed in a compressor 201*b* which is coupled to the expansion machine 201, subsequently supplied again to the main heat exchanger 1 at an intermediate temperature level, further heated, and subsequently supplied to the compressor 1401.

Figure 29:
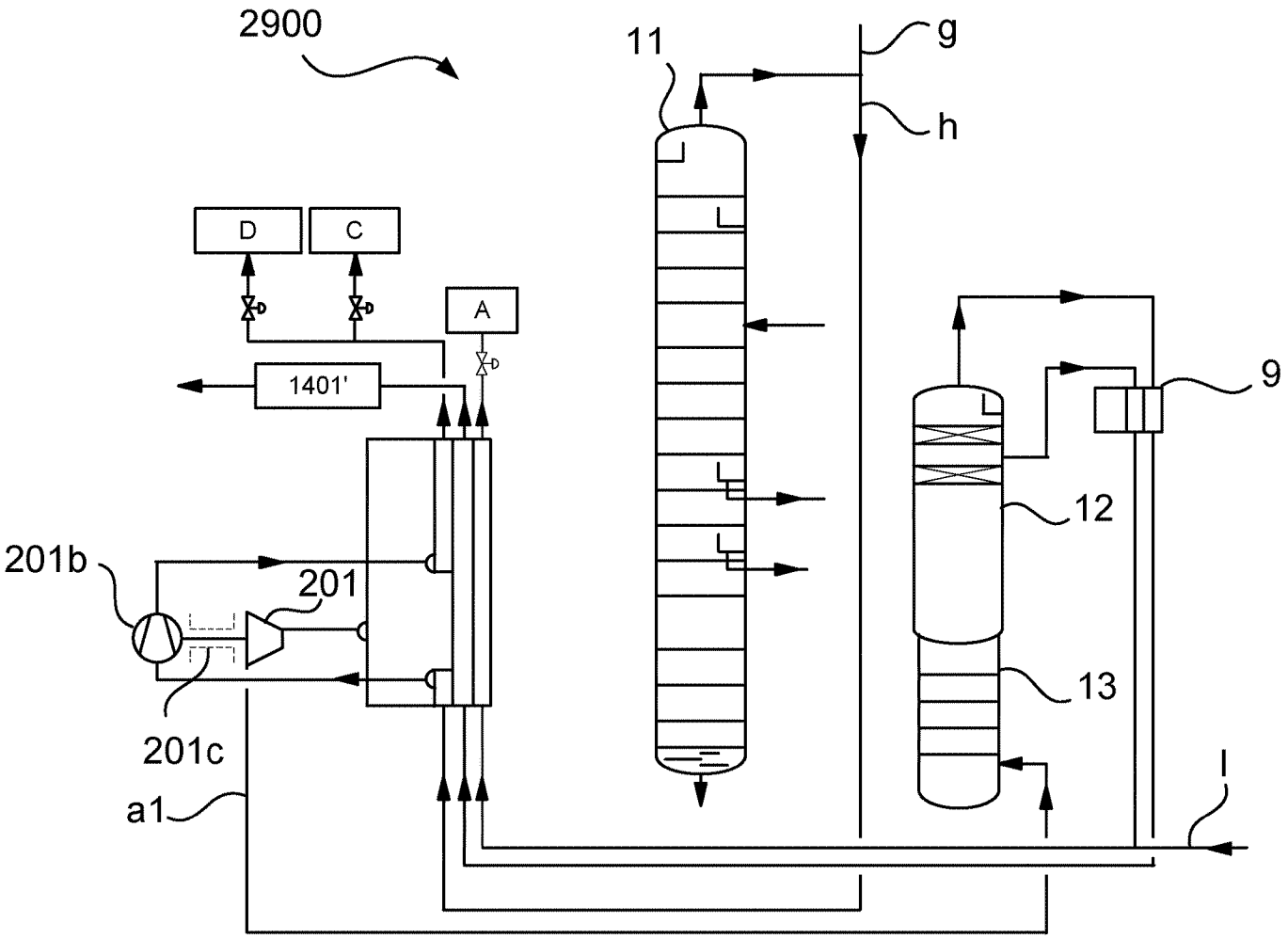

As illustrated in a partial representation in FIG. 29, in an air separation unit 2900, according to an embodiment of the invention, the nitrogen of the material flow h, as previously illustrated with respect to FIGS. 28 and 29, may also be correspondingly compressed. The use of the compressor designated by 1401' here is optional.

Figure 30:
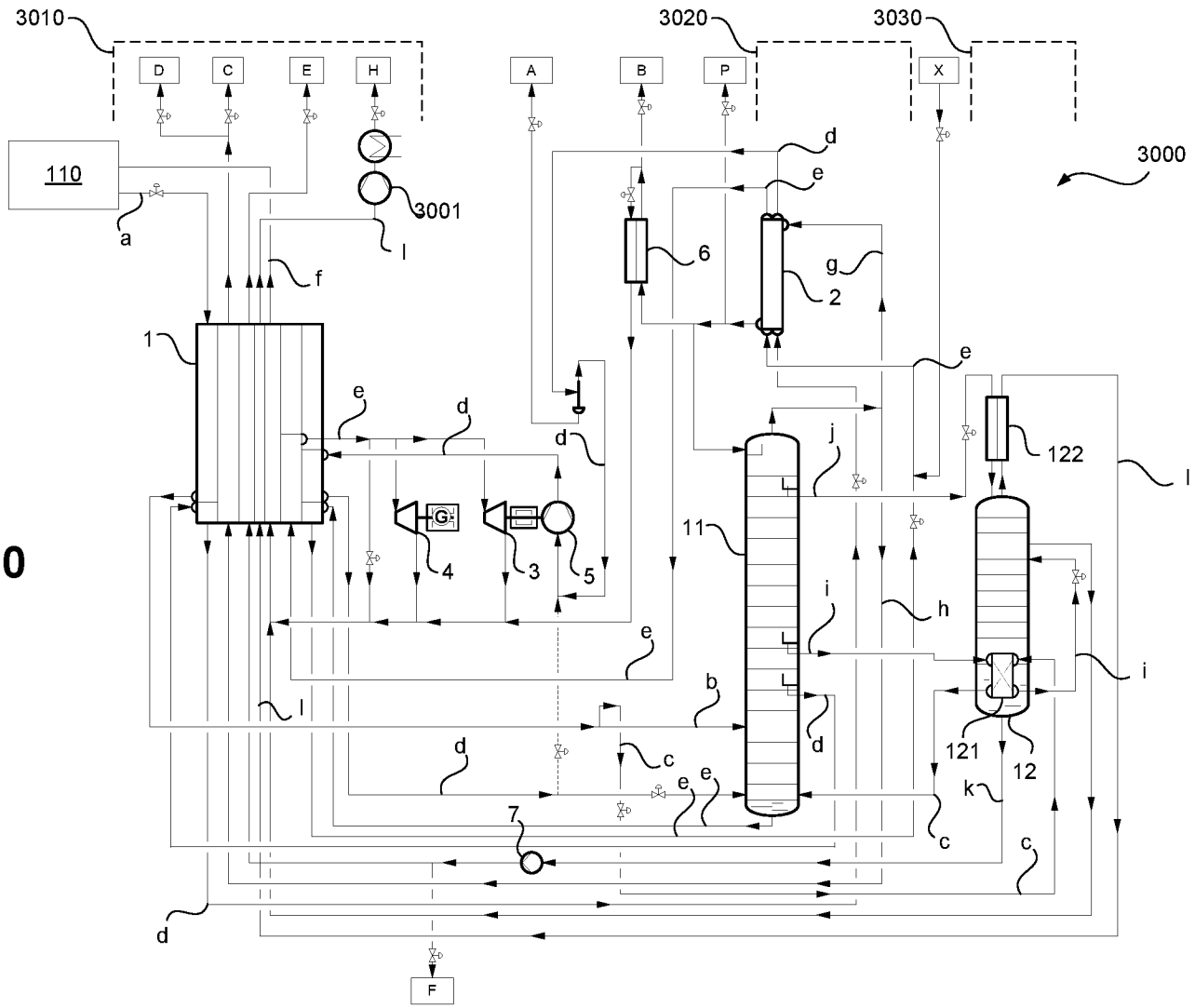

FIG. 30 illustrates an air separation unit 3000 in accordance with a non-inventive embodiment in the form of a schematic unit diagram.

The air separation unit 3000 according to FIG. 30 has major commonalities with the air separation unit 100 which is likewise not-inventive and is illustrated in FIG. 1. Only the differences are explained below.

Here, after being conducted through the condenser evaporator 121 of the second rectification column 12, the partial flow c is not combined with additional material flows before it is fed into the first rectification column 11. Furthermore, no portion of the material flow e is branched off here, as the material flow e1 in FIG. 1 or the air separation unit 100, so that the entire material flow e is supplied here to the heat exchanger 2. The material flow e is expanded here in the form of two partial flows in two expansion machines 3 and 4. The expansion machine 4 is coupled to a generator.

As illustrated here, above the material flow i, the material flow j here designated differently is discharged from the second rectification column and, in particular, added to the second rectification column 2 at the head. In the the material flow l is withdrawn from the head of the second rectification column 12 and can be heated without being combined with an additional material flow and, in particular after compression in a compressor 3001, can be discharged as an additional gaseous nitrogen product H from the air separation unit 100. The gaseous nitrogen product C represents the "additional nitrogen-rich air product" previously explained with reference to different embodiments of the invention.

As indicated here in a highly simplified manner, in the air separation unit 3000, the main heat exchanger 1 may be arranged in a first prefabricated cold box 3010. The first rectification column 11 with the heat exchanger 2 used to cool its head gas may be arranged in a second prefabricated cold box 3020. The second rectification column may be arranged in a third prefabricated cold box 3030. Unlike in the highly simplified representation of FIG. 1, these cold boxes completely each of the respectively mentioned elements.

Figure 31:
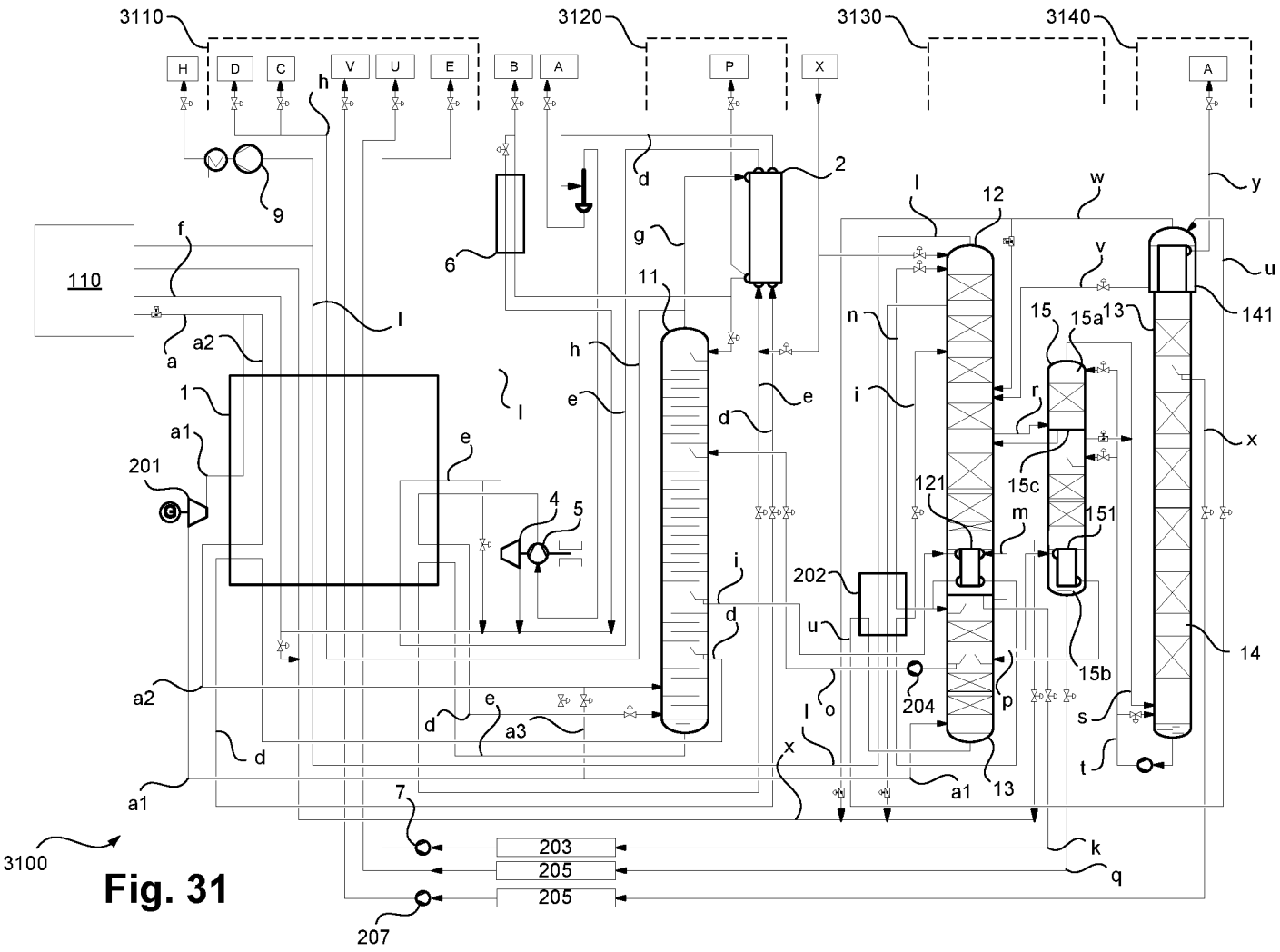

FIG. 31 shows a variant of the air separation unit 3000 according to FIG. 31, which however represents an embodiment of the present invention and is designated overall by 3100. In contrast to the unit 3000 illustrated in FIG. 30, a partial flow a1 of the feed air flow is provided here in addition to the third rectification column 13 mentioned several times, and furthermore an argon extraction is provided in a fourth rectification column 14. Furthermore, a fifth rectification column 15 is provided in the air separation unit 3100. The terms "first," "second," "third," "fourth," and "fifth" rectification column are used consistently with the specifications given above, so that reference may be made thereto.

The formation and treatment of the material flows d, e, f, g, h, i, k, and l takes place substantially as already explained with respect to the unit 100 or 3000 according to FIG. 1 or 30, wherein again only one expansion machine 4 is illustrated in the unit 3100 instead of the expansion machines 3 and 4, and the material flow i is not fed directly into the second rectification column 12 but is conducted beforehand through the condenser evaporator 121 and a supercooling heat exchanger 202. Furthermore, the material flow k can be temporarily stored in a tank system 203 in the example illustrated here. The material flow l is also conducted through the supercooling heat exchanger 202.

A material flow corresponding to the material flow j according to unit 100 is not formed here. Instead, a liquid return flow n to the second rectification column 12 is formed by drawing head gas in the form of a material flow m from the fourth rectification column and liquefying it in the condenser evaporator 121. A portion of the liquefied head gas is conducted as through the supercooling heat exchanger 202 and is used in the form of the material flow n; another non-designated portion is returned as a return flow to the first rectification column 11. Additional liquid may be provided in the form of the liquid nitrogen X. In the unit 200, a material flow o is returned from the third rectification column 13 into the first rectification column 1 by means of a pump 204.

The fifth rectification column 15 here also represents a double column; with regard to its function, reference is made to the above explanations. The lower part 15*b* is operated with a condenser evaporator 151 which is heated by using a material flow p that is drawn from the third rectification column 13 and is subsequently, i.e., downstream of the condenser evaporator 151, returned into the third rectification column 13. Furthermore, ultrahigh-purity oxygen in the form of a material flow q is drawn in the lower part 15*b*. This material flow q is transferred to a tank system 205, temporarily stored there, evaporated in the main heat exchanger 1, and provided as an ultrahigh-purity oxygen product U.

A material flow r is drawn from the second rectification column 12 in the region of the argon transition or below a material flow r and fed into the upper part 15*a* of the fifth rectification column 15 which is separated from the lower part 15*a* by a barrier bottom 15*c*. Liquid depositing on the barrier bottom 15*c* is returned to the second rectification column 12 below the material flow r. The head gas of the upper part 15*a* and of the lower part 15*b* of the fifth rectification column 15 is transferred via a material flow s into the fourth rectification column 14. The sump liquid of the fourth rectification column 14 is conducted in the form of a material flow t to the head of the lower part 15*a* and of the upper part 15*b* of the fifth rectification column 15.

A head condenser 141 of the third rectification column 13 is cooled using sump liquid of the second rectification column 12 in the form of a material flow u which has previously been conducted through the supercooling heat exchanger 202. Liquid from an evaporation chamber of the head condenser 141 is returned into the second rectification column 12 in the form of a material flow v. Gas from an evaporation chamber of the head condenser 141 is withdrawn in the form of a material flow w and in part expanded into the second rectification column 12, and in part used to form a residual gas flow x which also comprises fluid which is drawn from the second and third rectification columns 12, 13.

Below the head, argon-rich liquid in the form of a material flow x is drawn from the fourth rectification column 14. This liquid can be stored in a tank system 206 before it can be subjected to internal compression by means of a pump 207, heated, and provided as an argon product V. Uncondensed head gas of the fourth rectification column 14 can be discharged to the atmosphere A in the form of a material flow y.

The main heat exchanger 1 in the air separation unit 3100 according to FIG. 31 may also be arranged in a first prefabricated cold box 3110. The first rectification column 11 with the heat exchanger 2 used for cooling its head gas may be arranged in a second prefabricated cold box 3120. The second rectification column 12 together with the third rectification column 13 may be arranged in a third prefabricated cold box 3130. In the shown example, the fifth rectification column 15 is also arranged in the third cold box 3130. In the shown example, the fourth rectification column 14 is arranged in an additional prefabricated cold box 3140 in which, for example, the fifth rectification column 15 may however also be arranged. However, the fourth rectification column 14 may also be arranged in the third cold box 3130. Any distribution is possible.

It should again be emphasized that although measures according to individual embodiments of the invention are each described in the preceding figures as part of corresponding units, they may also each be used alone or in other units without departing from the scope of the present invention. For example, in all cases, a motor and/or a turbine operation of a compressor may be provided, and/or expansion machines may be braked by means of a generator and/or by means of brakes and/or by coupling with a compressor.

Although certain air separation units are described above as variants of units explained above, it goes without saying that each of the measures or features proposed herein may also be used in units other than each of those described as the basis.

The invention claimed is:

1. A method for low-temperature air separation, in which an air separation unit with a first rectification column and a second rectification column is used, wherein the first rectification column is operated at a first pressure level and the second rectification column is operated at a second pressure level below the first pressure level, fluid which is oxygen-enriched compared to atmospheric air is drawn from the first rectification column in the form of one or more first material flows, at least one fraction of the fluid drawn from the first rectification column in the form of the one or more first material flows is heated in a heat exchanger, a fraction of the fluid heated in the heat exchanger is compressed using a compressor and returned to the first rectification column, a first fraction of the head gas of the first rectification column is condensed in the heat exchanger, and a second fraction thereof is discharged from the air separation unit in the form of at least one nitrogen-rich air product, additional fluid containing oxygen, nitrogen, and argon is drawn from the first rectification column and used as a second material flow or to form a second material flow which is transferred to the second rectification column, and an oxygen-rich sump liquid is formed in the sump of the second rectification column, and at least one fraction thereof is discharged in the form of a third material flow from the air separation unit, wherein a third rectification column is used, wherein the second rectification column and the third rectification column are designed as parts of a double column, the third rectification column is arranged below the second rectification column, and the third rectification column is supplied with air.

2. The method according to claim 1, in which the air supplied to the third rectification column comprises compressed and cooled air which is expanded using an expansion machine.

3. The method according to claim 2, in which the second rectification column is operated with a condenser evaporator which is arranged in a sump region of the second rectification column and which is heated using fluid drawn from and/or supplied to the third rectification column.

4. The method according to claim 3, in which the air supplied to the third rectification column is at least partially liquefied in the condenser evaporator arranged in the sump region of the second rectification column and is returned to the third rectification column as a liquid return flow.

5. The method according to claim 3, in which a head gas is formed in the third rectification column and is liquefied at least in part in the condenser evaporator arranged in the sump region of the second rectification column and is returned as a return flow to the second and/or the third rectification column.

6. The method according to claim 3, in which a sump liquid is formed in the third rectification column and is at least in part fed into the second rectification column.

7. The method according to claim 1, in which a nitrogen-rich head gas is formed in the second rectification column, and at least one fraction thereof is discharged from the air separation unit as an additional nitrogen-rich air product, wherein a residual oxygen content of the head gas of the first rectification column is 1 ppb to 10 ppm, and a residual oxygen content of the head gas of the second rectification column is 10 ppb to 100 ppm.

8. The method according to claim 7, in which the second rectification column is equipped with 50 to 120 theoretical bottoms, and/or a nitrogen-rich liquid material flow is provided and added as a return flow to an upper region of the second rectification column.

9. The method according to claim 1, wherein fluid which has a higher argon content than the oxygen-rich sump liquid of the second rectification column is drawn from the second rectification column and used as a third material flow or to form a third material flow, a fourth rectification column is used into which the third material flow is fed, wherein an argon-rich fluid having a content of more than 95 mole percent argon is formed in the fourth rectification column.

10. The method according to claim 9, in which a fifth rectification column is used in which a liquid is formed having an oxygen content above an oxygen content of the oxygen-rich sump liquid formed in the sump of the second rectification column, and in which the fifth rectification column is used to form the third material flow using the fluid drawn from the second rectification column and having a higher argon content than the oxygen-rich sump liquid of the second rectification column.

11. The method according to claim 9, in which wherein a quantity of the argon product formed in the air separation unit comprises 1 to 85 percent of a total argon quantity supplied as a whole in the form of air to the air separation unit.

12. An air separation unit having a first rectification column and a second rectification column, which is configured:

to operate the first rectification column at a first pressure level and the second rectification column at a second pressure level below the first pressure level, to draw fluid which is oxygen-enriched compared to atmospheric air, from the first rectification column in the form of one or more first material flows, to heat in a heat exchanger at least one fraction of the fluid drawn from the first rectification column in the form of the one or more first material flows, to compress using a compressor a fraction of the fluid heated in the heat exchanger and to return it to the first rectification column, a first fraction of the head gas of the first rectification column is condensed in the heat exchanger, and a second fraction thereof is discharged from the air separation unit in the form of at least one nitrogen-rich air product, to draw additional fluid containing oxygen, nitrogen, and argon from the first rectification column and to use it as a second material flow or to form a second material flow which is transferred to the second rectification column, and to form an oxygen-rich sump liquid in the sump of the second rectification column and to discharge at least one fraction thereof in the form of a third material flow from the air separation unit, wherein a third rectification column is provided, wherein the second rectification column and the third rectification column are designed as parts of a double column, and the third rectification column is arranged below the second rectification column, wherein the air separation unit is configured to supply the third rectification column with air.

13. The air separation unit according to claim 12, which is configured to carry out a method for low-temperature air separation, in which an air separation unit with a first rectification column and a second rectification column is used, wherein the first rectification column is operated at a first pressure level and the second rectification column is operated at a second pressure level below the first pressure level, fluid which is oxygen-enriched compared to atmospheric air is drawn from the first rectification column in the form of one or more first material flows, at least one fraction of the fluid drawn from the first rectification column in the form of the one or more first material flows is heated in a heat exchanger, a fraction of the fluid heated in the heat exchanger is compressed using a compressor and returned to the first rectification column, a first fraction of the head gas of the first rectification column is condensed in the heat exchanger, and a second fraction thereof is discharged from the air separation unit in the form of at least one nitrogen-rich air product, additional fluid containing oxygen, nitrogen, and argon is drawn from the first rectification column and used as a second material flow or to form a second material flow which is transferred to the second rectification column, and an oxygen-rich sump liquid is formed in the sump of the second rectification column, and at least one fraction thereof is discharged in the form of a third material flow from the air separation unit, wherein a third rectification column is used, wherein the second rectification column and the third rectification column are designed as parts of a double column, the third rectification column is arranged below the second rectification column, and the third rectification column is supplied with air.

* * * * *